US009388015B2

(12) United States Patent
Suzuki et al.

(10) Patent No.: US 9,388,015 B2
(45) Date of Patent: Jul. 12, 2016

(54) SHEET PROCESSING APPARATUS AND IMAGE FORMING SYSTEM

(71) Applicants: Michitaka Suzuki, Kanagawa (JP); Shuuya Nagasako, Kanagawa (JP); Tomohiro Furuhashi, Kanagawa (JP); Kyosuke Nakada, Kanagawa (JP); Akira Kunieda, Tokyo (JP); Takahiro Watanabe, Kanagawa (JP); Yuji Suzuki, Kanagawa (JP)

(72) Inventors: Michitaka Suzuki, Kanagawa (JP); Shuuya Nagasako, Kanagawa (JP); Tomohiro Furuhashi, Kanagawa (JP); Kyosuke Nakada, Kanagawa (JP); Akira Kunieda, Tokyo (JP); Takahiro Watanabe, Kanagawa (JP); Yuji Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/271,373

(22) Filed: May 6, 2014

(65) Prior Publication Data

US 2014/0336031 A1 Nov. 13, 2014

(30) Foreign Application Priority Data

May 13, 2013 (JP) ..... 2013-101313
Feb. 26, 2014 (JP) ..... 2014-035721

(51) Int. Cl.
*B65H 45/04* (2006.01)
*B65H 45/14* (2006.01)
*B65H 45/20* (2006.01)

(52) U.S. Cl.
CPC ..... *B65H 45/04* (2013.01); *B65H 45/14* (2013.01); *B65H 45/147* (2013.01); *B65H 45/20* (2013.01); *B65H 2801/27* (2013.01)

(58) Field of Classification Search
CPC ..... B65H 45/04; B65H 45/20; B65H 45/147
USPC ..... 270/32, 39.01; 493/416, 419, 434, 435, 493/421, 440, 442
See application file for complete search history.

(56) References Cited

U.S. PATENT DOCUMENTS

| | | | | |
|---|---|---|---|---|
| 6,730,010 | B2 * | 5/2004 | Yamakawa et al. | 493/267 |
| 7,052,005 | B2 * | 5/2006 | Yamakawa et al. | 270/37 |
| 7,871,065 | B2 * | 1/2011 | Fukasawa et al. | 270/37 |
| 7,909,316 | B2 * | 3/2011 | Kawaguchi | 270/32 |
| 8,469,358 | B1 * | 6/2013 | Wen | 271/250 |
| 8,506,465 | B2 | 8/2013 | Terhaag et al. | |
| 8,628,457 | B2 | 1/2014 | Terlau | |
| 2007/0238596 | A1 | 10/2007 | Terhaag et al. | |

FOREIGN PATENT DOCUMENTS

| | | | |
|---|---|---|---|
| CN | 101049879 | A | 10/2007 |
| CN | 101683940 | B | 4/2015 |
| EP | 1022246 | A2 | 7/2000 |

(Continued)

OTHER PUBLICATIONS

U.S. Appl. No. 14/070,932, filed Nov. 4, 2013.

*Primary Examiner* — Leslie A Nicholson, III
(74) *Attorney, Agent, or Firm* — Duft Bornsen & Fettig LLP

(57) ABSTRACT

A sheet processing apparatus includes: a first conveying member pair that folds a sheet; a second conveying member pair that conveys downstream the sheet folded by the first conveying member pair; and a third conveying member pair that further folds the sheet folded by the first conveying member pair. The second conveying member pair is rotatable forward and reversely when driven to convey, and is locked in one rotational direction but is rotatable in the other rotational direction when not driven.

12 Claims, 19 Drawing Sheets

(56) References Cited

FOREIGN PATENT DOCUMENTS

| | | |
|---|---|---|
| JP | 2006-076776 | 3/2006 |
| JP | 2006-117383 | 5/2006 |
| JP | 2010-083632 | 4/2010 |
| JP | 5094174 | 9/2012 |
| JP | 2014101164 A | 6/2014 |

* cited by examiner

SHEET PROCESSING APPARATUS AND IMAGE FORMING SYSTEM

CROSS-REFERENCE TO RELATED APPLICATIONS

The present application claims priority to and incorporates by reference the entire contents of Japanese Patent Application No. 2013-101313 filed in Japan on May 13, 2013 and Japanese Patent Application No. 2014-035721 filed in Japan on Feb. 26, 2014.

BACKGROUND OF THE INVENTION

1. Field of the Invention

The present invention relates to sheet processing apparatuses and image forming systems, and in particular to a sheet processing apparatus that performs a folding process on a sheet-like recording medium conveyed (in the present specification, referred to as sheet) such as paper, transfer paper, printing paper, and an OHP transparency, and an image forming system that includes the sheet processing apparatus and an image forming apparatus such as a copier, a printer, a facsimile, and a digital multifunction peripheral.

2. Description of the Related Art

As a sheet processing apparatus that performs a folding process on a sheet conveyed from an image forming apparatus, a technology described in Japanese Laid-open Patent Publication No. 2006-117383 is known, for example. This technology features a sheet processing apparatus that includes a first stopping member the position of which provided in a second conveying path is movable to stop a leading end of a sheet, a conveying roller pair formed of a first conveying roller and a second conveying roller that nips the deflection of the sheet to form a crease at the first stopping member, a second stopping member the position of which provided in a first conveying path is movable to stop the sheet that passed the conveying roller pair, and a conveying roller pair formed of the second conveying roller and a third conveying roller that nips the deflection of the sheet to form a crease at the second stopping member, and forms a double parallel fold by controlling the stopping position of the second stopping member 10.

This technology is to perform what is called a leading-end abutment folding process by providing a dedicated path bifurcated from a conveying path, in which a sheet conveyed from an upstream device is conveyed to a downstream device, and stoppers to perform the folding process, and by abutting the leading end of the sheet on the stopper. More specifically, in the folding process, the folding position is adjusted and a deflection is formed by abutting the sheet on the stopper in the dedicated path, and the deflection formed is nipped by a folding unit to fold.

Meanwhile, the technology described in Japanese Laid-open Patent Publication No. 2007-277006, for example, is also known. This technology features a method of folding a medium by a folding device that includes a rotatable folding cylinder, a rotatable first press member that engages with the folding cylinder to form a first folding pinch, a rotatable second press member that engages with the folding cylinder to form a second folding pinch, and a media feeding unit, and the method includes feeding the medium by the feeding unit toward the cylinder that is intermediate between the first pinch and the second pinch, rotating the cylinder in a first direction to direct the medium in the first pinch to form looseness in the medium in the middle of the feeding unit and the cylinder, and rotating the cylinder in a second direction opposite to the first direction to move the looseness in the second pinch to fold.

More specifically, as the conventional methods to fold, two methods are generally used; one is to adjust the folding position, when a sheet on which an image is formed is received and a folding process such as letter fold and Z-fold is performed thereon, by abutting the leading end of the sheet on a sheet leading-end abutment member that is operable in accordance with the sheet size as disclosed in Japanese Laid-open Patent Publication No. 2006-117383 (hereinafter, referred to as a stopper method), and the other is to adjust the folding position by adjusting only the amount of conveyance by a conveying unit as disclosed in Japanese Laid-open Patent Publication No. 2007-277006 (hereinafter, referred to as a nip-reverse method).

In the stopper method described in Japanese Laid-open Patent Publication No. 2006-117383, the leading end of a folded portion of the sheet is abutted on the stopper, and in the second folding process, a sheet portion (a single sheet portion) on the first fold side, which is formed in the first folding process, is in a stopped state at all times. Consequently, the deflection of the sheet that arises in the second folding process is nipped by a second folding roller pair, and after the deflection is eliminated, the sheet portion (a single sheet portion) on the first fold side is then started to move, and thus a duplicate fold Pc is not likely to occur. However, a mechanism to move the sheet leading-end abutment member in accordance with the length of the sheet is necessary, and thus the downsizing of the apparatus is difficult as the installation space for the mechanism is essential.

Meanwhile, in the nip-reverse method described in Japanese Laid-open Patent Publication No. 2007-277006, the folding position is adjusted by only the adjustment of the amount of conveyance, and thus it excels in terms of downsizing. In letter fold, Z-fold, and such in which a sheet folding process is performed twice, however, when the second sheet folding process is performed, it is necessary to make an upstream side conveying unit (hereinafter, referred to as a first folding roller pair) and a downstream side conveying unit (hereinafter referred to as a forward-reverse roller pair) convey in directions conflicting with each other to form a deflection in the sheet. In this case, the first folding roller pair conveys the sheet in the downstream direction while the forward-reverse roller pair conveys the sheet in the upstream direction. Then, a second folding roller pair positioned downstream of the forward-reverse roller pair performs the second folding process on the deflected sheet. In such case, two creases referred to as duplicate folding or a duplicate fold may result.

FIGS. 28 to 31 are explanatory diagrams illustrating the mechanism of a duplicate fold to arise. In letter fold, Z-fold, and such in which the sheet folding process is performed twice, when the second sheet folding process is performed, a first folding roller pair 2 and a forward-reverse roller pair 3 are made to convey a sheet P in directions conflicting with each other (the first folding roller pair 2 in the downstream direction and the forward-reverse roller pair 3 in the upstream direction) to form a deflection Pt1 in the sheet P, and the second folding process is then performed by a second folding roller pair 4. Consequently, a sheet portion (a single sheet portion) P1 a including a leading end P1 of the sheet P on the first fold side, which is formed in the first folding process, may be drawn into the nip of the second folding roller pair 4 before a deflection Pt2 disappears (FIG. 29). When the second folding process is performed under this condition (FIG. 30), what is called a duplicate fold Pc arises in which two creases Pc1 and Pc2 are formed (FIG. 31).

To prevent this duplicate fold Pc from arising, when it is attempted to stop the leading end P1 of the sheet P formed in the first folding process (stop the forward-reverse roller pair 3) short of the nip of the second folding roller pair 4 (FIG. 32), the second folding roller pair 4 and the forward-reverse roller pair 3 are to pull the sheet P from both sides at an instant the deflection Pt2 in the second folding disappears (FIG. 33). Thus, it only needs to rotate the forward-reverse roller pair 3 at the instant the deflection Pt2 of the second fold disappears to eliminate the pull from both sides. However, it is not practical to configure the forward-reverse roller pair 3 to rotate in the foregoing manner to eliminate the pull from both sides in terms of dynamics and control due to inertia, and thus it is difficult to eliminate the sheet P to be pulled from both sides with such a mechanism.

There is a need to prevent a duplicate fold from arising in the second sheet folding process when the folding process is performed by the nip-reverse method.

SUMMARY OF THE INVENTION

It is an object of the present invention to at least partially solve the problems in the conventional technology.

A sheet processing apparatus includes: a first conveying member pair that folds a sheet; a second conveying member pair that conveys downstream the sheet folded by the first conveying member pair; and a third conveying member pair that further folds the sheet folded by the first conveying member pair. The second conveying member pair is rotatable forward and reversely when driven to convey, and is locked in one rotational direction but is rotatable in the other rotational direction when not driven.

An image forming system includes a sheet processing apparatus as described above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

In the present invention, a drive portion of a forward-reverse roller pair is provided with play that allows the forward-reverse roller pair to convey a sheet upstream and downstream when the forward-reverse roller pair is continued to rotate, and to be locked in the downstream direction but to be free in the other direction (the upstream direction) as much as the play when the forward-reverse roller pair is stopped to permit the sheet to be pulled out easily when pulled from upstream, and the forward-reverse roller pair is rotated before the play runs out so as to prevent a duplicate fold when the second folding is performed.

The present invention will be described with a plurality of exemplary embodiments with reference to the accompanying drawings.

First Embodiment

Figure 1:
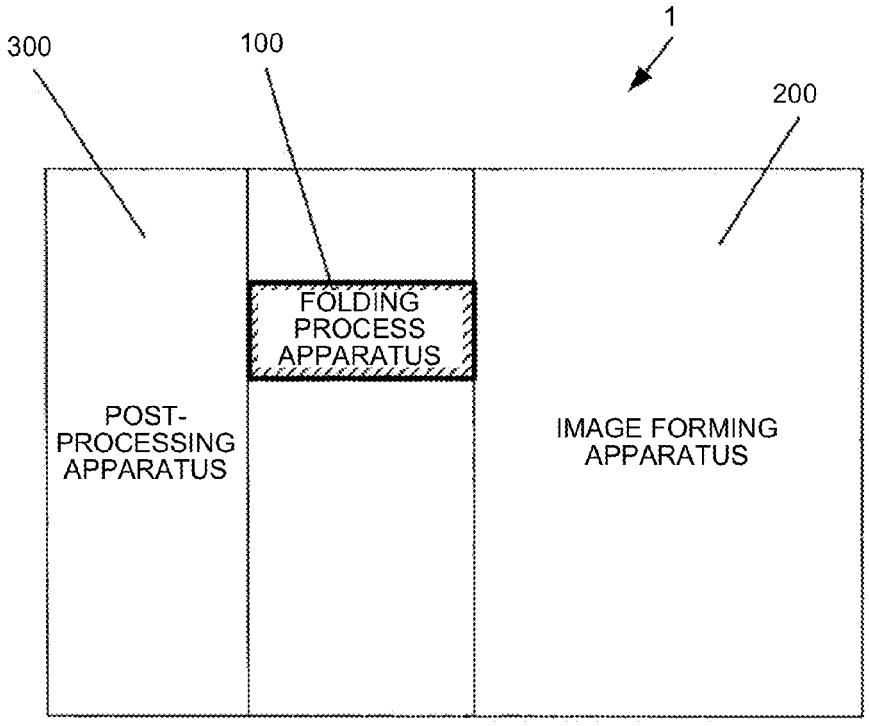
FIG. 1 is a diagram schematically illustrating the configuration of an image forming system according to a first embodiment of the present invention.

FIG. 1 is a diagram schematically illustrating the configuration of an image forming system according to a first embodiment of the invention. In FIG. 1, an image forming system 1 in the first embodiment is basically configured with an image forming apparatus 200, a folding process apparatus 100, and a post-processing apparatus 300. The folding process apparatus 100 is provided between the image forming apparatus 200 in an upstream stage and the post-processing apparatus 300 in a downstream stage. A sheet on which an image is formed by the image forming apparatus 200 is conveyed to the folding process apparatus 100, and after a given folding process is performed thereon by the folding process apparatus 100, is further conveyed to the post-processing apparatus 300. In the post-processing apparatus 300, post processing such as alignment process, binding process, or bookbinding process is performed on folded or not-folded sheets, for example.

Figure 2:
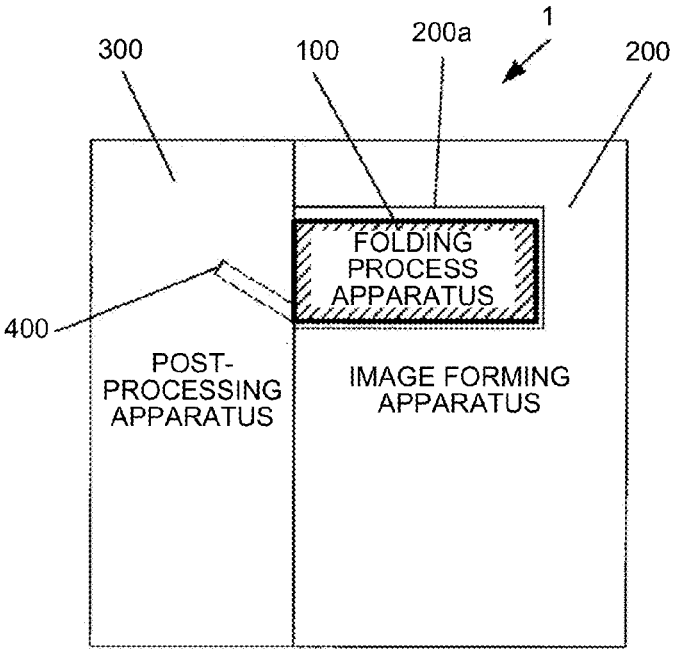
FIG. 2 is a diagram schematically illustrating the configuration of the image forming system in the first embodiment in another form.

FIG. 2 is a diagram schematically illustrating the configuration of the image forming system in the first embodiment in another form. In FIG. 2, the folding process apparatus 100 is what is called a built-in type and is provided at a discharging unit inside the image forming apparatus 200. In the image forming system 1 illustrated in FIG. 2, the folding process apparatus 100 is provided at an inner discharging unit 200*a* and only a discharge tray 400 is projecting from the footprint of the image forming apparatus 200, and thus the system is substantially downsized as compared with the form depicted in FIG. 1.

Figure 3:
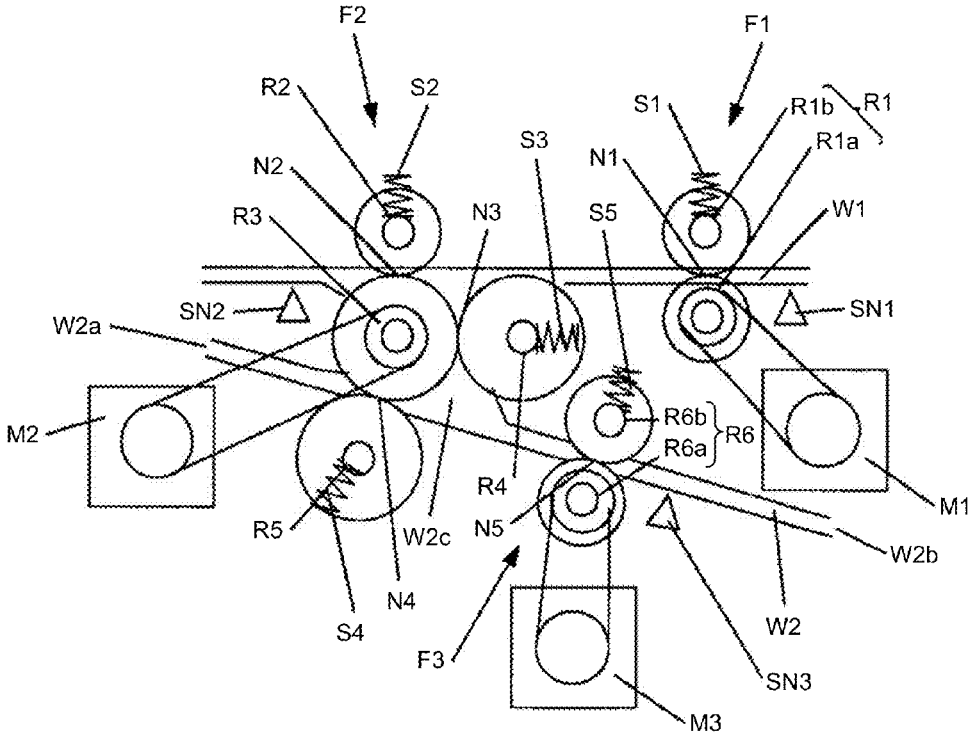
FIG. 3 is a diagram illustrating a folding mechanism of a folding process apparatus in FIGS. 1 and 2.

FIG. 3 is a diagram illustrating a folding mechanism of the folding process apparatus 100 in FIGS. 1 and 2.

The folding process apparatus 100 includes two conveying paths of a first conveying path W1 and a second conveying path W2, and along these two conveying paths W1 and W2, a plurality of conveying members of first, second, and third conveying members F1, F2, and F3, are disposed. The second conveying member F2 is disposed to sandwich the first conveying path W1 and the second conveying path W2, and has a function to fold and deliver a sheet P from the first conveying path W1 to the second conveying path W2.

The first conveying member F1 is composed of a first conveying roller pair R1. The second conveying member F2 is composed of first, second, third, and fourth conveying rollers R2, R3, R4, and R5. The third conveying member F3 is composed of a second conveying roller pair R6. The first conveying roller pair R1 and the second conveying roller pair R6 (the first conveying member F1 and the third conveying member F3) are driven by a first drive motor M1 and a third drive motor M3, respectively, and exert conveying force on the sheet P.

The first conveying roller pair R1 is provided in the first conveying path W1 on the entrance side of the folding process apparatus 100 to receive sheets from the image forming apparatus 200 in the upstream stage, and is driven by the first drive motor M1 to convey the sheet P to downstream of the folding process apparatus 100.

In the first embodiment, although not depicted, the second conveying path W2 is configured such that an end portion W2a thereof on the downstream side in a sheet conveying direction (on a discharging side) is merged with the downstream side of the first conveying path W1, and an end portion W2b thereof on the upstream side in the sheet conveying direction is merged with the first conveying roller pair R1 on the upstream side or is in an open state as illustrated in FIG. 3. At the installation location of the second conveying member F2 in the first conveying path W1 downstream of the first conveying roller pair R1, the first conveying path W1 is connected with the second conveying path W2 via a communication path W2c.

In the second conveying member F2, the first conveying roller R2 and the second conveying roller R3 face each other across the first conveying path W1 forming a second nip N2 between them. The second conveying roller R3 and the third conveying roller R4 are disposed between the first conveying path W1 and the second conveying path W2 to face each other forming a third nip N3 between them. A path guided by the third nip N3 serves as the communication path W2c that introduces a sheet from the first conveying path W1 to the second conveying path W2. Furthermore, the second conveying roller R3 and the fourth conveying roller R5 face each other across the second conveying path W2 forming a fourth nip N4 between them.

These first to fourth conveying rollers R2 to R5 are driven by a second drive motor M2 that drives the second conveying roller R3. More specifically, the second conveying member F2 is driven by the second drive motor M2. The second drive motor M2 is rotatable in both normal and reverse directions, and by changing the directions of rotation, conveys the sheet P and performs a folding process. The second conveying member F2 may be configured not only with the pairs of conveying rollers but also with pairs of adhesive conveying rollers or suction belts.

In the second conveying member F2, the second conveying roller R3 is a drive conveying roller, and the first, the third, and the fourth conveying rollers R2, R4, and R5 are driven conveying rollers that rotate in contact with the second conveying roller R3. The second conveying roller R3 and the third conveying roller R4 constitute a first folding roller pair 2, and the second conveying roller R3 and the fourth conveying roller R5 constitute a second folding roller pair 4.

On the first, the third, and the fourth conveying rollers R2, R4, and R5, an elastic force toward the second conveying roller R3 side is exerted by first, second, and third compression springs (elastic members) S2, S3, an S4, respectively, and the respective contact with the second conveying roller R3 is retained. Consequently, the three conveying rollers R2, R4, and R5 are driven by receiving a driving force from the second conveying roller R3.

The first conveying roller pair R1 is composed of a drive conveying roller R1a and a driven conveying roller R1b, and the drive conveying roller R1a is applied with the driving force from the first drive motor M1. The driven conveying roller R1b is applied with an elastic force toward the drive conveying roller R1a side by a first compression spring S1 to contact at a first nip N1, and is driven under such condition. The second conveying roller pair R6 is composed of a drive conveying roller R6a and a driven conveying roller R6b, and the drive conveying roller R6a is applied with the driving force from the third drive motor M3 in a synchronized state via a gear mechanism. The driven conveying roller R6b is applied with an elastic force toward the drive conveying roller R6a side by a fifth compression spring S5 to contact at a fifth nip N5, and is driven under such condition.

Furthermore, immediately before the first conveying roller pair R1 in the first conveying path W1, a first sheet detecting sensor SN1 is disposed; immediately after the nip between the first conveying roller R2 and the second conveying roller R3, a second sheet detecting sensor SN2 is disposed; and immediate to the second conveying roller pair R6 in the second conveying path W2 on the side away from the fourth conveying roller R5, a third sheet detecting sensor SN3 is disposed. The first sheet detecting sensor SN1 serves as an entrance sheet detecting sensor, and the second sheet detecting sensor SN2 serves as a discharging sheet detecting sensor.

Figure 4:
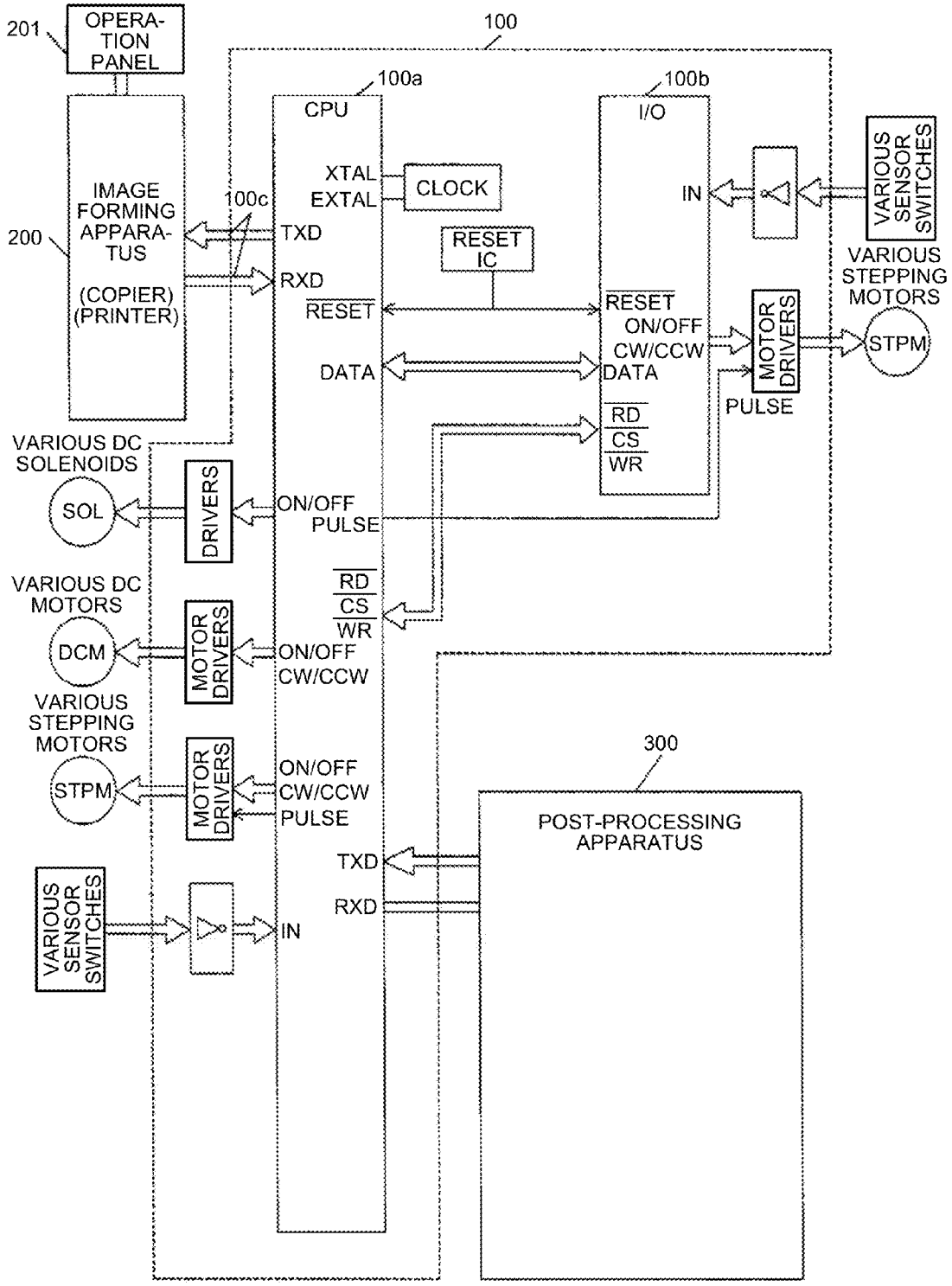
FIG. 4 is a block diagram illustrating the control configuration of the image forming system in the first embodiment.

FIG. 4 is a block diagram illustrating the control configuration of the image forming system in the first embodiment.

In FIG. 4, the folding process apparatus 100 includes a microcomputer-mounted control circuit provided with a CPU 100*a*, an I/O interface 100*b*, and others. The CPU 100*a* receives signals from a CPU or various switches on an operation panel 201, and various sheet detecting sensors not depicted of the image forming apparatus 200 via a communication interface 100*c*. The CPU 100*a* executes a given control based on the signals received from the image forming apparatus 200 side. The CPU 100*a* further performs drive control on solenoids and motors via drivers and motor drivers, respectively, and acquires the information of sheet detecting sensors internal of the apparatus from an interface. Moreover, for a controlled object, the CPU 100*a* performs drive control of a motor by a motor driver and acquires sheet detecting sensor information from a sheet detecting sensor via the I/O interface 100*b*, for example.

The above-described control is executed by the CPU 100*a*, by reading a program code stored in a ROM not depicted and by loading it on a RAM not depicted, based on a program defined by the program code while using the RAM as a work area and a data buffer.

In the first embodiment, the folding mechanism illustrated in FIG. 3 can perform half fold, Z-fold, letter fold, and 6-page accordion fold. The behavior in these various folds and a later-described rotation drive control of rollers and others are instructed and executed by the CPU 100*a* illustrated in FIG. 4.

Figure 11:
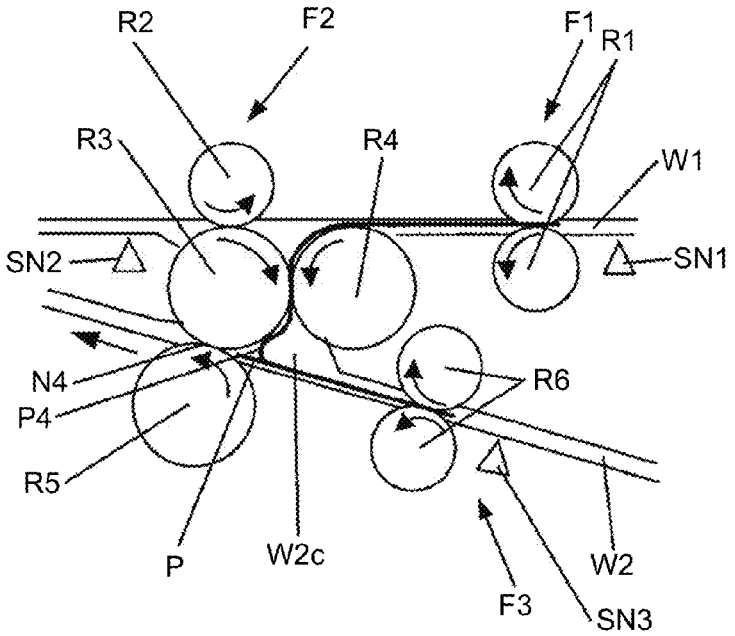
FIG. 11 is a diagram for explaining behavior illustrating a condition in which the forward-reverse roller pair is rotated in reverse to convey the sheet toward a second folding roller pair from the condition depicted in FIG. 10.
Figure 12:
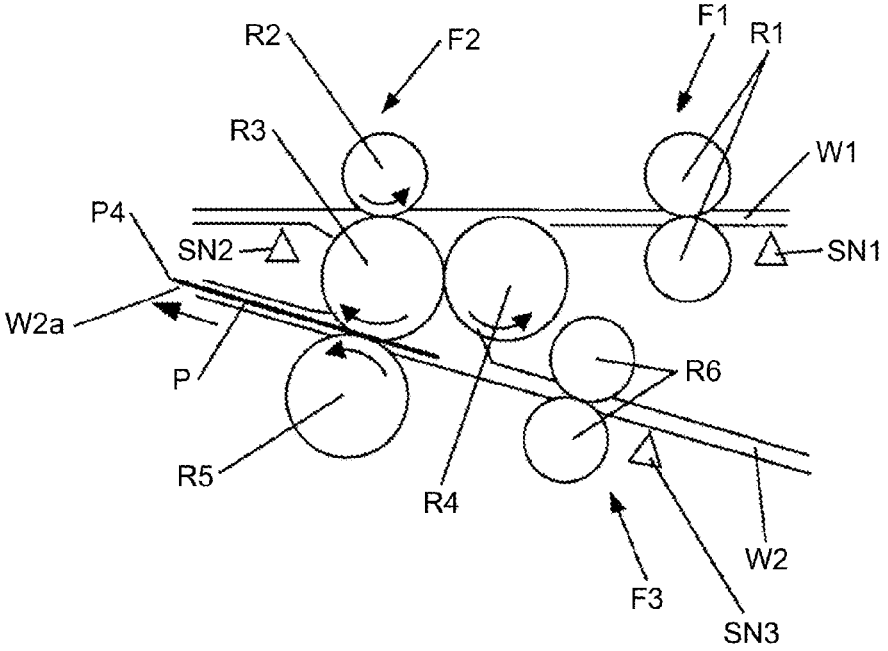
FIG. 12 is a diagram for explaining behavior illustrating a condition in which the second fold is performed on the sheet by the second folding roller pair and the sheet is conveyed downstream from the condition depicted in FIG. 11.
Figure 13:
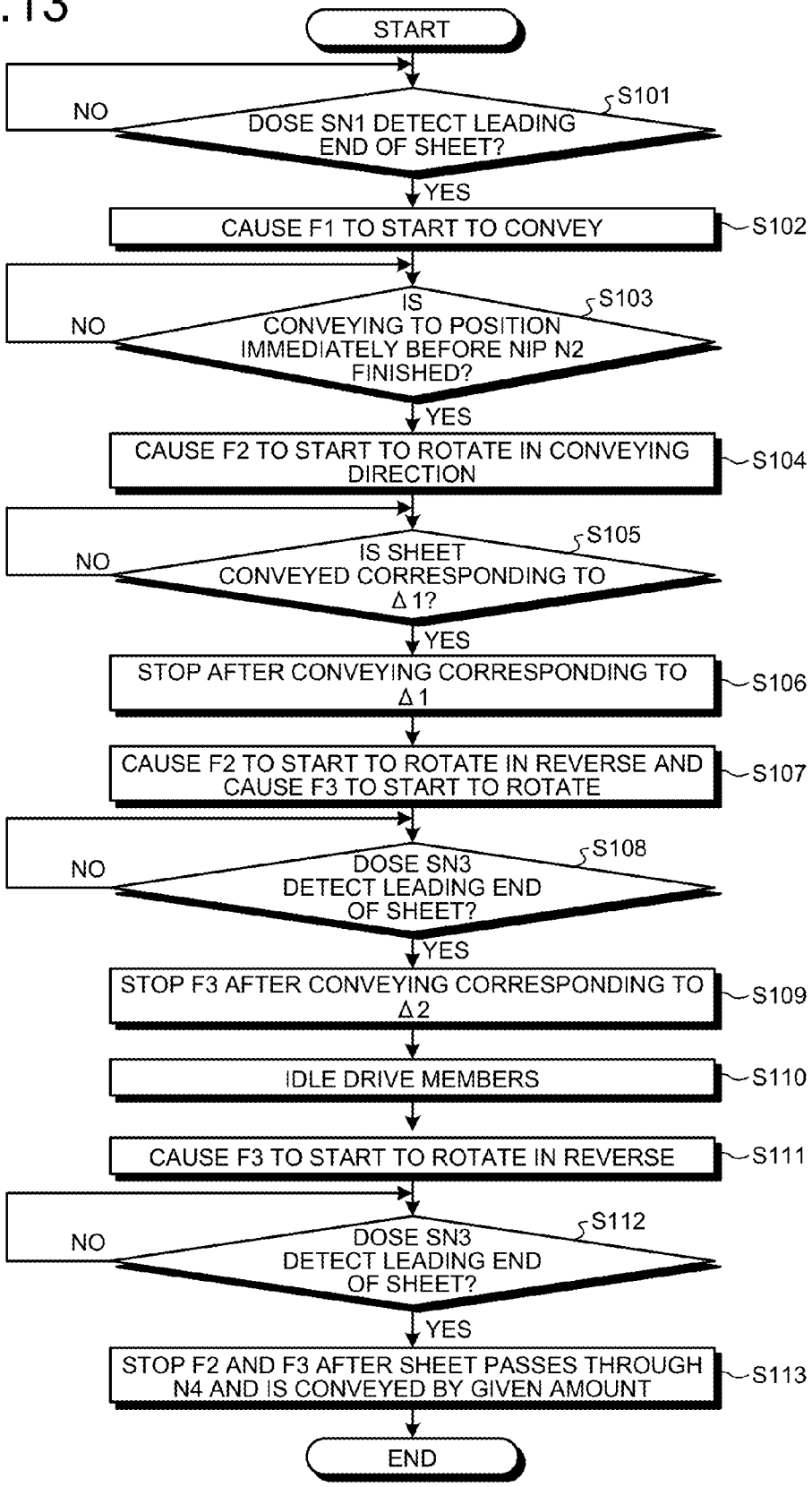
FIG. 13 is a flowchart illustrating a procedure to control the behavior of the various portions when Z-fold is performed.

FIGS. 5 to 12 are diagrams for explaining behavior illustrating an outline of the behavior of the various portions when Z-fold is performed. FIG. 13 is a flowchart illustrating a procedure to control the behavior of the various portions.

Figure 5:
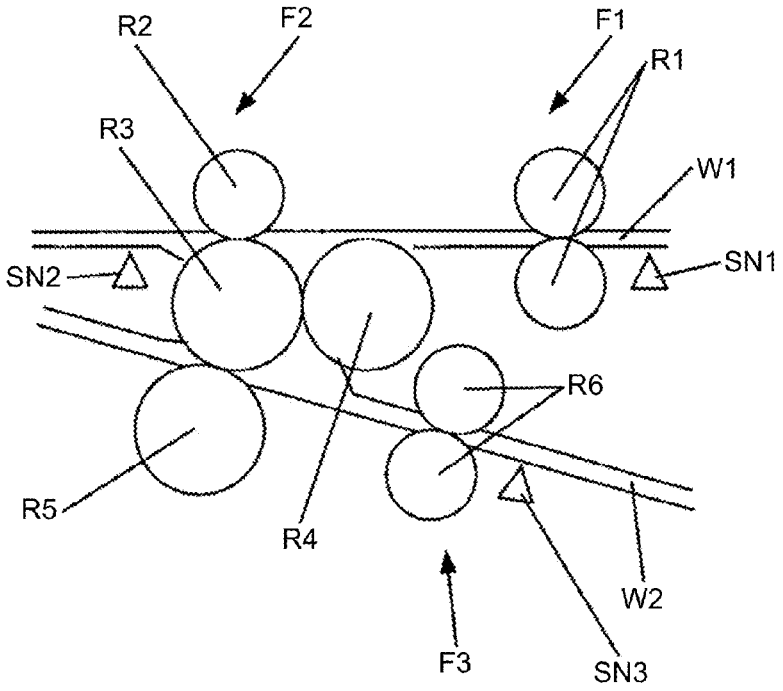
FIG. 5 is a diagram for explaining behavior illustrating an initial condition before a sheet is conveyed from an image forming apparatus side.
Figure 6:
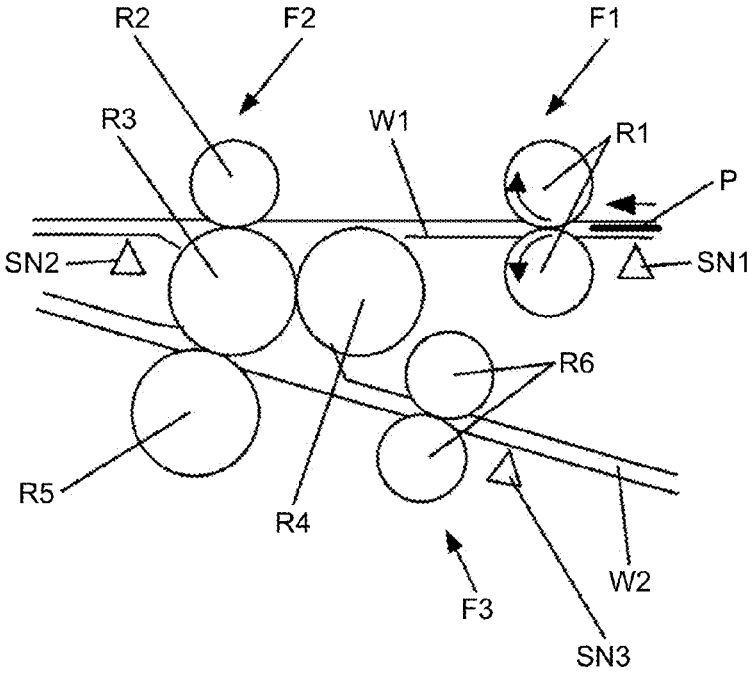
FIG. 6 is a diagram for explaining behavior illustrating a condition in which the sheet is conveyed into a first conveying path from the condition depicted in FIG. 5.

FIG. 5 illustrates an initial condition before a sheet is conveyed from the image forming apparatus 200 side. From the condition depicted in FIG. 5, the sheet P is conveyed, as illustrated in FIG. 6, into the first conveying path W1 from the image forming apparatus 200 side. When the first sheet detecting sensor (the entrance sheet detecting sensor) SN1 detects a leading end P1 of the sheet P (Step S101), the first drive motor M1 that is the first conveying member F1 starts to rotate (in arrows R1 directions). When the sheet P goes into the first nip N1 of the first conveying roller pair R1, the sheet P is conveyed toward the second conveying member F2 downstream by the first conveying roller pair R1 (Step S102). The sheet P, the leading end of which reached the second conveying member F2, is nipped by the second nip N2 between the first conveying roller R2 and the second conveying roller R3 and is conveyed further downstream.

Figure 7:
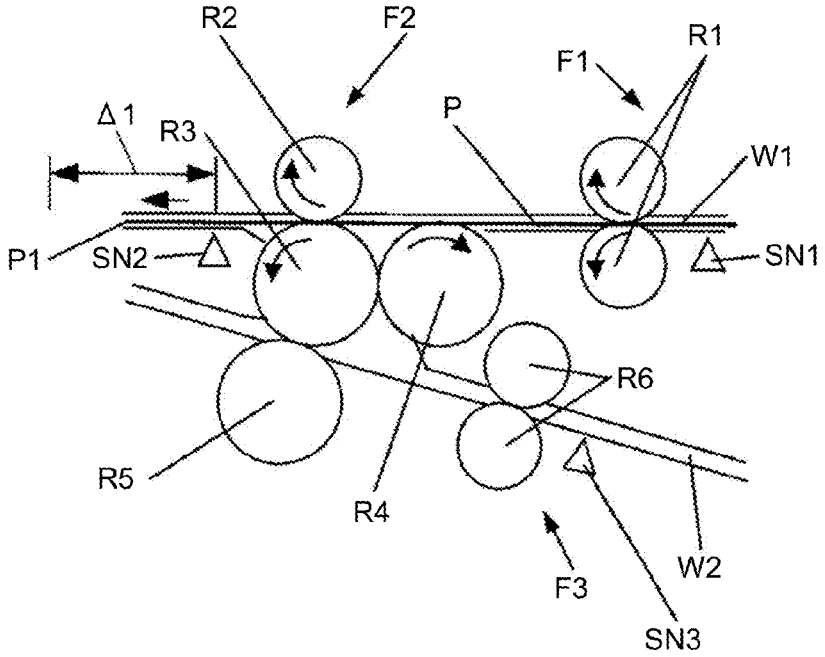
FIG. 7 is a diagram for explaining behavior illustrating a condition in which the sheet is conveyed until the leading end of the sheet reaches a first amount of projection from a second sheet detecting sensor from the condition depicted in FIG. 6.

At the time the sheet is conveyed to a position immediately before the second nip N2 between the second conveying roller R3 and the third conveying roller R4 (Step S103), the second drive motor M2 then starts to drive and rotates the second conveying member F1 in the directions of arrows depicted in FIG. 7 (Step S104). Whether the sheet P is conveyed to a position immediately before the second nip N2 can be determined from the rotational speed of the first drive motor M1 that drives the first conveying member F1 (or the linear velocity of the first conveying roller pair R1) and the conveying time, for example.

Figure 8:
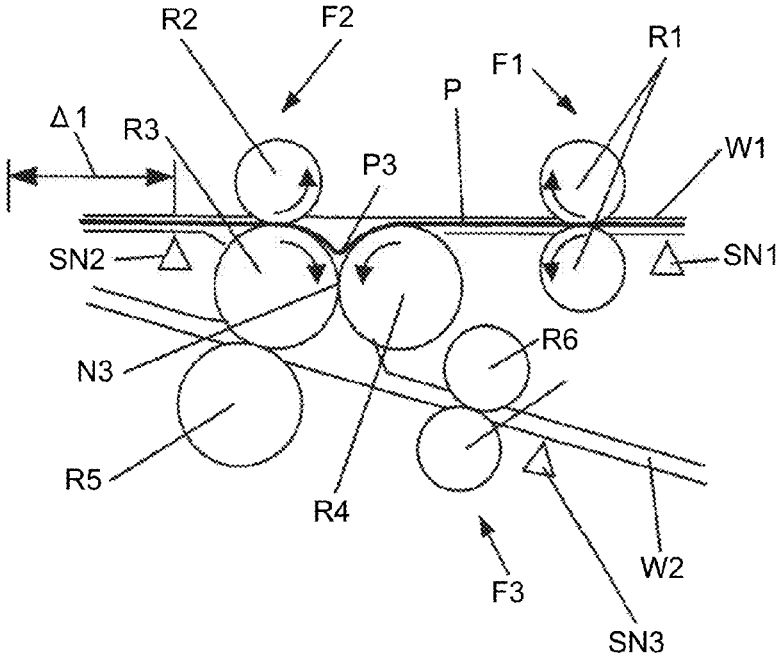
FIG. 8 is a diagram for explaining behavior illustrating a condition in which a second conveying member pair is rotated in reverse to put a crease while a first conveying member is kept on rotating in a conveying direction from the condition depicted in FIG. 7.

After the second conveying member F1 is started to rotate in the directions of arrows depicted in FIG. 7 at Step S104, an amount of projection (a first projecting amount) Δ1 from the position of the second sheet detecting sensor SN2 is determined to set a folding position (Step S105). In Z-fold, an outward fold (the first fold) is made at a position one quarter of the entire length of the sheet from the leading end P1 of the sheet P in the sheet conveying direction, and an inward fold (the second fold) is made at a position one half of the entire length. The position depicted in FIG. 8 is the position in which a crease P3 is formed at one quarter position from the leading end P1 of the sheet P. The setting of this position is also performed by the CPU 100*a* by calculation or by referring to a ROM table.

More specifically, the sheet P is conveyed until the leading end P1 of the sheet P reaches the first projecting amount Δ1 from the position at which the leading end P1 of the sheet P is detected by the second sheet detecting sensor SN2. The first projecting amount Δ1 is defined by the length of sheet and the method of fold, and is determined by the amount of rotation of the first conveying roller R2. At the time the leading end P1 of the sheet P reaches the first projecting amount Δ1 (Yes at Step S105), the second conveying member F2 is stopped once (Step S106). In such case, the second drive motor M2 is decelerated at the time the leading end P1 of the sheet P is detected by the second sheet detecting sensor SN2, and the sheet P is conveyed up to the first projecting amount Δ1 and is stopped at that position. This deceleration enables highly precise stop-position control.

For the setting of the first moving amount Δ1, the CPU 100*a* receives, before a job is started (before an image forming is performed on the sheet P), data of the length of the sheet P in the conveying direction from the image forming apparatus 200, automatically calculates the moving amount based on the data, and uses the result of calculation. The moving amount can be set in accordance with the sheet size, without having to calculate it, by storing in advance the relation of the sheet size and the moving amount in a table in the ROM.

Next, as illustrated in FIG. 8, while the first conveying member F1 is kept on rotating in the conveying direction, the second conveying member F2 (the second conveying roller R3) is driven to rotate in a reverse direction with respect to the conveying direction depicted up to FIG. 7 (Step S107). The first projecting amount Δ1 can also be determined by the amount of conveyance of the first conveying member F1 from the position of the first sheet detecting sensor SN1.

Figure 9:
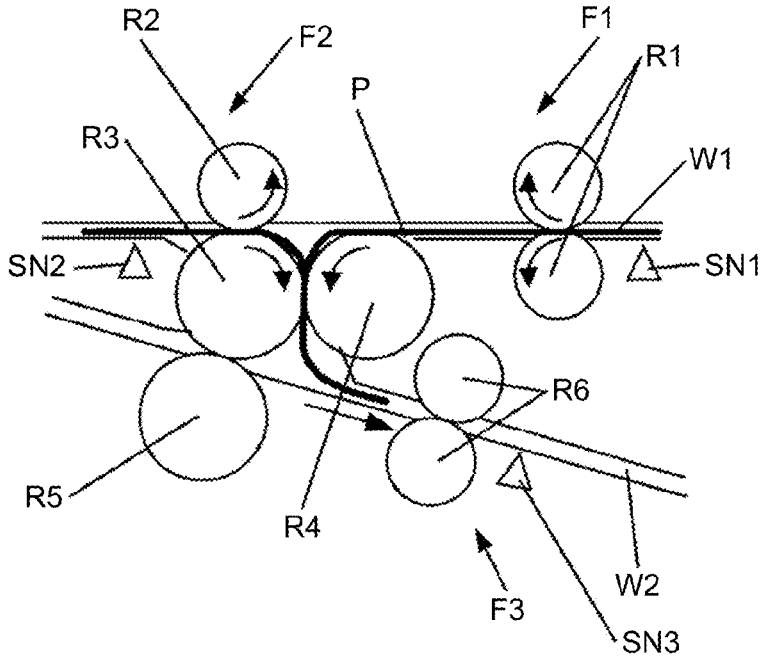
FIG. 9 is a diagram for explaining behavior illustrating a condition in which the sheet on which a first fold is formed by a first folding roller pair is conveyed to a second conveying path from the condition depicted in FIG. 8.

By the reverse rotation of the second conveying member F2 (the second drive motor M2), the sheet P is conveyed in a reverse direction. Meanwhile, because the first conveying member F1 is rotating in the direction continued from that depicted in FIG. 6 to convey the sheet P, a deflection is formed at the position short of the third nip N3 as the same for half fold (FIG. 8). This deflection goes into the third nip N3 and the first folding is performed. This forms the first crease P3. The sheet P on which the first fold is performed is conveyed to the second conveying path W2 as illustrated in FIG. 9.

Figure 10:
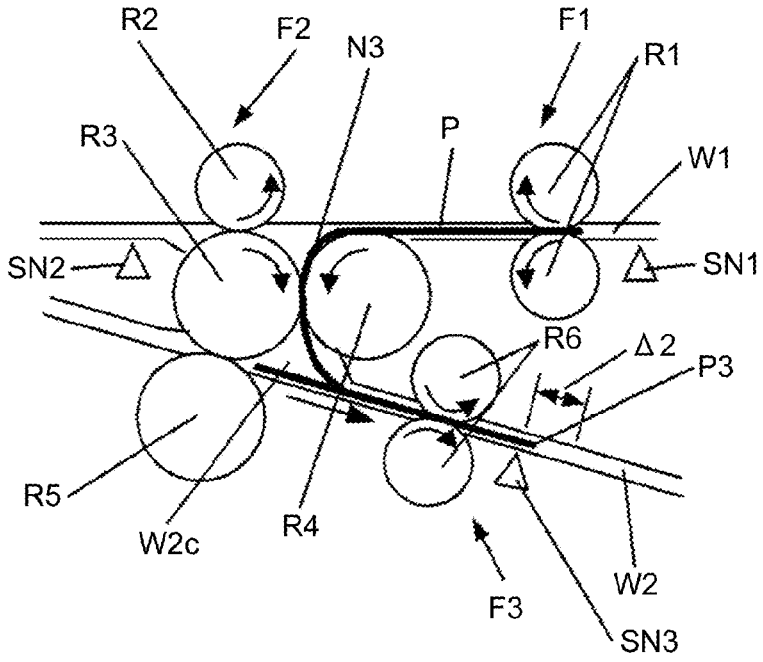
FIG. 10 is a diagram for explaining behavior illustrating a condition in which the sheet is conveyed along the second conveying path and is conveyed downstream being nipped by a forward-reverse roller pair from the condition depicted in FIG. 9.

The sheet P is conveyed along the downslope inclination of the second conveying path W2, and is nipped and conveyed by the fifth nip N5 of the second conveying roller pair R6 that is started to rotate in the directions of arrows as illustrated in FIG. 10 (Step S107). The leading end (the first crease P3) of the sheet P is then detected by the third sheet detecting sensor SN3 (Step S108), and when the sheet P reaches the position projecting by a second projecting amount Δ2 from the detected position, the third conveying member F3 (the second conveying roller pair R6: the third drive motor M3) stops (Step S109). Then, as illustrated in FIG. 11, when the sheet P is conveyed in the arrow direction by the second folding roller pair 4 (the pair of the second conveying roller R3 and the fourth conveying roller R5), drive members 3*a*4 are moved within idling areas 3*a* to idle until the play of the drive members 3*a*4 runs out (Step S110).

Next, after the sheet P is pulled by the second folding roller pair 4, and a preset time that is before the play of the drive members 3*a*4 runs out elapses, the forward-reverse roller pair 3 (the second conveying roller pair R6) is started to rotate in reverse (Step S111). The behavior at Steps S110 and S111 and the mechanism to make this behavior will be described later. The second projecting amount Δ2 can also be set as the amount of projection from the fifth nip N5.

The second projecting amount Δ2 is determined from the length of sheet and the method of fold as the same as the first projecting amount Δ1, and is determined by the amount of rotation of the forward-reverse roller pair 3 (the second conveying roller pair R6) (the number of driving steps of the third drive motor M3). To perform such control, the first, the second, and the third drive motors M1, M2, and M3 are configured with stepping motors in the first embodiment. The various drive motors M1 to M3 can be configured with motors other than stepping motors, for example, DC motors. In that case, a control method appropriate to the form of the motors employed is used. For example, when a DC motor is used, the projecting amount or drive-stop timings are controlled based on the number of counts of encoder pulses.

When a DC motor is used for the drive of the forward-reverse roller pair 3, it is preferable to use a DC motor and its driving device disclosed in Japanese Laid-open Patent Publication No. 2012-213308, for example. The use of such a DC motor permits the normal and reverse rotation to be performed quickly, whereby productivity can be improved. Furthermore, no loss of synchronism occurs for load fluctuation as in the case of stepping motors. Moreover, the positional deviation due to load fluctuation is corrected by feedback control, and thus the motor can be rotated at an accurate position at all times. As a consequence, the fold can be performed at an accurate position, and thus a high folding quality can be ensured.

The reverse rotation of the forward-reverse roller pair 3 (the second conveying roller pair R6) is performed in a condition in which the rotational direction of the first folding roller pair 2 (the second conveying roller R3 and the third conveying roller R4) illustrated in FIGS. 9 and 10 is maintained. Consequently, as illustrated in FIG. 11, a deflection (a later described Pt1) is formed in the sheet P in the communication path W2c downstream of the third nip N3.

When the drive of the second conveying member F2 and the third conveying member F3 in the directions of rotations illustrated in FIG. 11 is continued, the deflection (the later described Pt1) goes into the fourth nip N4 of the second folding roller pair 4 (the second conveying roller R3 and the fourth conveying roller R5), and thus the sheet P is conveyed in the direction of the end portion W2a of the second conveying path W2 on the discharging side. In the course of the conveyance, the second folding is performed as illustrated in FIG. 12, and a second crease P4 is formed on the sheet P. The sheet P on which the second folding is performed is further conveyed from the end portion W2a on the discharging side to the post-processing apparatus 300 in a downstream stage passing through the first conveying path W1. Alternatively, the sheet P is discharged to the discharge tray 400.

Figure 19:
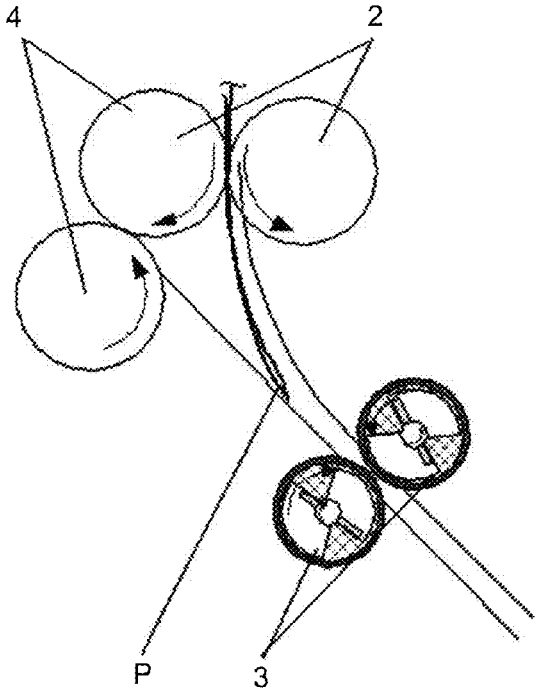
FIG. 19 is a diagram for explaining behavior illustrating a condition in which the forward-reverse roller pair is rotating before the sheet conveyed by the first folding roller pair goes into the nip of the forward-reverse roller pair.

In FIG. 12, when the trailing end of the sheet P is detected to pass by the third sheet detecting sensor SN3 (Step S112) and after the sheet P goes out of the fourth nip N4, the second conveying member F2 and the third conveying member F3 (the second drive motor M2 and the third drive motor M3) stop rotating (Step S113). The first drive motor M1 stops rotating, as illustrated in FIG. 19, at the time the trailing end of the sheet breaks away from the first nip N1 after the trailing end of the sheet is detected by the first sheet detecting sensor SN1.

The outline of Z-fold performed in the first embodiment is as described above. In the first embodiment, however, to avoid the above-described duplicate fold phenomenon, preset play (an idling area) is provided to the rotation mechanism of the forward-reverse roller pair 3, which rotates forward and reversely, or on a drive mechanism that drives the rotation mechanism, and the control is carried out as described at Steps S110 and S111.

More specifically, the forward-reverse roller pair 3 has the following three basic functions of:

(a) being capable of conveying the sheet P upstream and downstream, (b) being not moved due to the stiffness of the sheet P (the sheet P is not delivered downstream from the stopped position) when the forward-reverse roller pair 3 stops, and (c) idling when the forward-reverse roller pair 3 is started to rotate forward or reversely.

The function (b) is to ensure the accuracy of folding position. The function (c) is to permit the sheet P to be pulled out easily when it is pulled by the second folding roller pair 4 to avoid a duplicate fold phenomenon. For the function (c), in the first embodiment, provided is play (an idling area) 3*a* in which any part of the drive mechanism idles when the forward-reverse roller pair 3 is started to rotate forward or reversely.

Figure 14A:
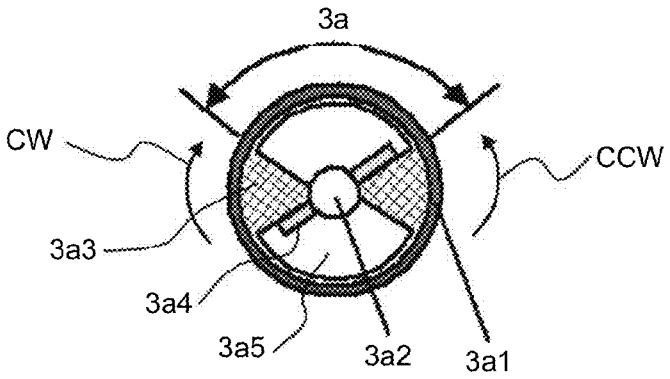
FIGS. 14A to 14D are diagrams conceptually illustrating the configuration of a drive portion body of the forward-reverse roller pair having play (an idling area)

FIGS. 14A to 14D are diagrams conceptually illustrating the configuration of a drive portion body 3*a*1 of the forward-reverse roller pair 3 having the play (an idling area) 3*a*. As illustrated in FIG. 14A, each roller of the forward-reverse roller pair 3 is composed of the drive portion body 3*a*1, a driving shaft 3*a*2, and the drive member 3*a*4 that transmits the driving force of the driving shaft 3*a*2 to a driven portion 3*a*3 of a roller body 3*a*. The drive member 3*a*4 idles in a void portion 3*a*5 within the drive portion body 3*a*1, and at the time it hits against the driven portion 3*a*3, is able to transmit the driving force to the drive portion body 3*a*1 side in one direction. In the other direction, however, the drive portion body 3*a*1 is configured to be locked and not to rotate.

For example, under the condition in FIG. 14A, when the driving shaft 3*a*2 rotates in the clockwise direction (in the arrow CW direction), the drive portion body 3*a*1 rotates directly in the clockwise direction (in the arrow CW direction). In contrast, when the driving shaft 3*a*2 rotates in the counter-clockwise direction (in the arrow CCW direction) under the condition in FIG. 14A, the driving shaft 3*a*2 and the drive member 3*a*4 idle up to the position illustrated in FIG. 14B. Even when the drive member 3*a*4 pushes the driven portion 3*a*3 transmitting the driving force, the drive portion body 3*a*1 is locked in this direction, and thus the drive portion body 3*a*1 does not rotate. Conversely, while the drive member 3*a*4 is positioned within the void portion 3*a*5 without contacting the driven portion 3*a*3, the drive portion body 3*a*1 idles.

Figures 14B, 14C, 14D:
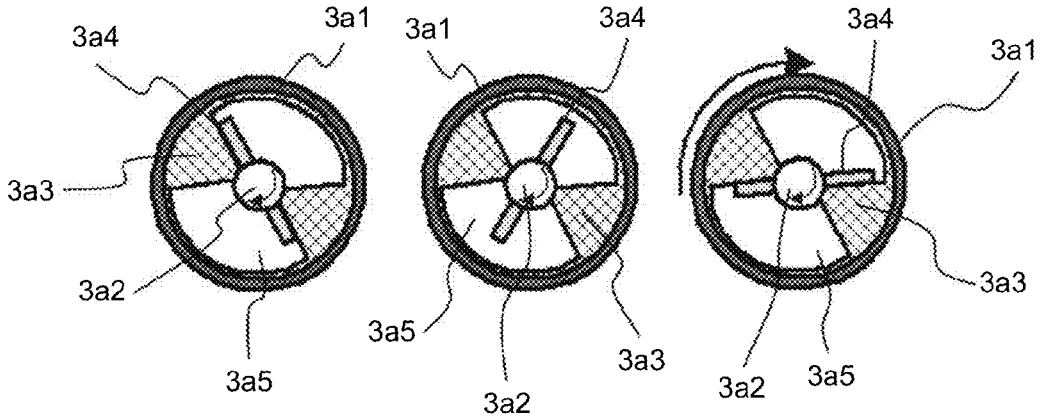

More specifically, because the drive member 3*a*4 is positioned within the idling area 3*a* from the condition in FIG. 14B until the drive member 3*a*4 hits against the side surface of the driven portion 3*a*3 as the driving shaft 3*a*2 rotates in the clockwise direction (in the arrow CW direction), the driving force is not transmitted, and thus the drive portion body 3*a*1 does not rotate (FIG. 14C). The driving force is then transmitted to the drive portion body 3*a*1 side at the time the drive member 3*a*4 hits against the driven portion 3*a*3 as the play within the idling area 3*a* runs out, and the drive portion body 3*a*1 starts to rotate (FIG. 14D).

While the mechanism with the idling area 3*a* is provided within the drive portion body 3*a*1 that drives the forward-reverse roller pair 3 in FIGS. 14A to 14D, it can be provided to another drive mechanism, for example, on a gear side. Furthermore, it can be provided in a driving-force transmitting path from a driving shaft of a motor, which transmits the driving force to the gear, to the gear. In any case, it can be provided in the driving-force transmitting path from a driving source to the forward-reverse roller pair 3. The forward-reverse roller pair 3 rotates in synchronization with the rotation of the drive portion body 3*a*1. Consequently, the rotational behavior of the drive portion body 3*a*1 is equivalent to that of the forward-reverse roller pair 3.

Figure 15:
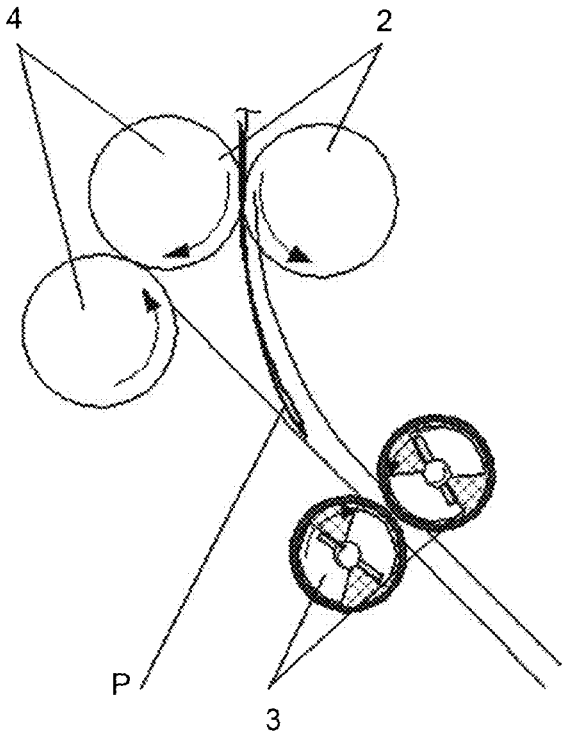
FIG. 15 is a diagram for explaining operating principle illustrating a condition in which the forward-reverse roller pair starts rotating at the time the play in the idling area disappears.

FIGS. 15 to 18 are explanatory diagrams illustrating the principle of conveying operation of the forward-reverse roller pair 3 having the play illustrated in FIGS. 14A to 14D. When the sheet P is conveyed from the first folding roller pair 2, the forward-reverse roller pair 3 is rotating in the direction to convey the sheet P downstream. When the forward-reverse roller pair 3 continues to rotate, the play in the idling area 3*a* runs out, and at the time the play runs out, the forward-reverse roller pair 3 starts to rotate and is ready to convey the sheet P downstream (FIG. 15). The forward-reverse roller pair 3 conveys the sheet P for a given amount, and then rotates in reverse (FIG. 16) and makes the leading end P1 of the sheet P stop short of the fourth nip N4 of the second folding roller pair 4.

At this time, the forward-reverse roller pair 3 is stopped and is locked in one rotational direction (the downstream direction). Consequently, the forward-reverse roller pair 3 is not moved due to the stiffness of the sheet P, and thus the sheet P is not delivered downstream from the stopped position. Meanwhile, the other rotational direction (the upstream direction) is free for the play (for the idling area 3*a*), and thus the sheet P can be pulled out easily when the leading end P1 of the sheet P is nipped and pulled by the fourth nip N4 of the second folding roller pair 4 (FIG. 17).

Furthermore, when the sheet deflection portion Pt1 is nipped by the second folding roller pair 4, the extra deflection Pt2 on the downstream side is eliminated, and the sheet P is subsequently pulled out from the forward-reverse roller pair 3 by the driving force of the second folding roller pair 4. In such case, because the forward-reverse roller pair 3 can idle when the sheet P is moved in the upstream direction, the sheet P can be pulled out without any load (FIG. 18) and is conveyed by the second folding roller pair 4 while being folded in a deflection-free condition.

Figure 16:
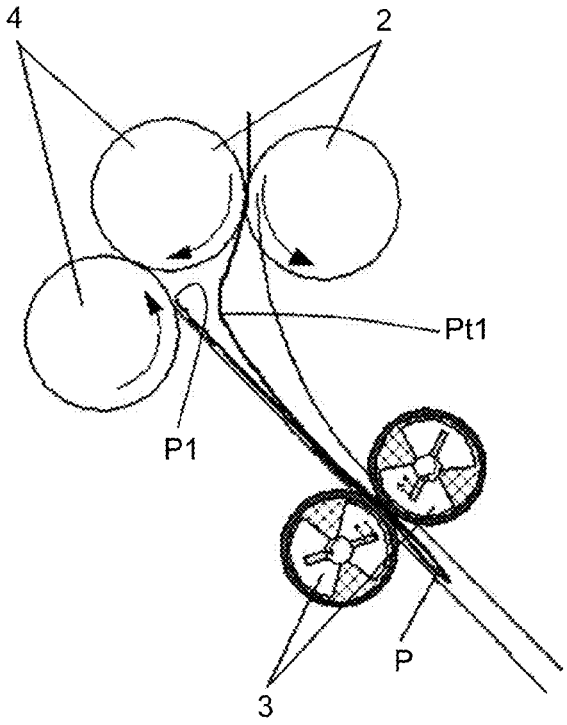
FIG. 16 is a diagram for explaining operating principle illustrating a condition in which the sheet is conveyed for a given amount and the forward-reverse roller pair is rotated in reverse from the condition depicted in FIG. 15.
Figure 17:
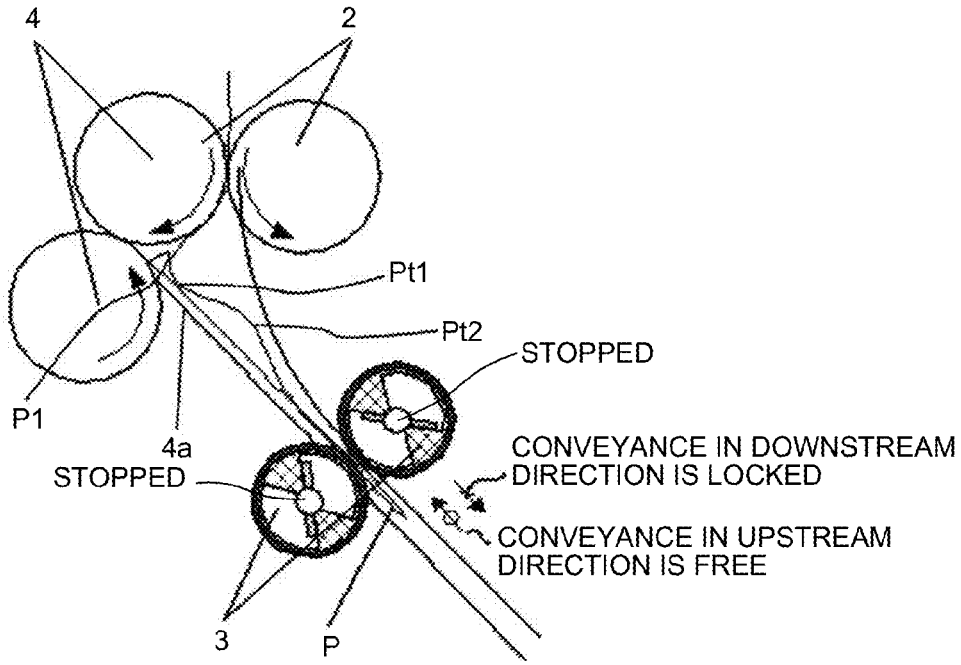
FIG. 17 is a diagram for explaining operating principle illustrating that the sheet is easily pulled out as drive members idle when the leading end of the sheet is nipped and pulled by the nip of the second folding roller pair.
Figure 18:
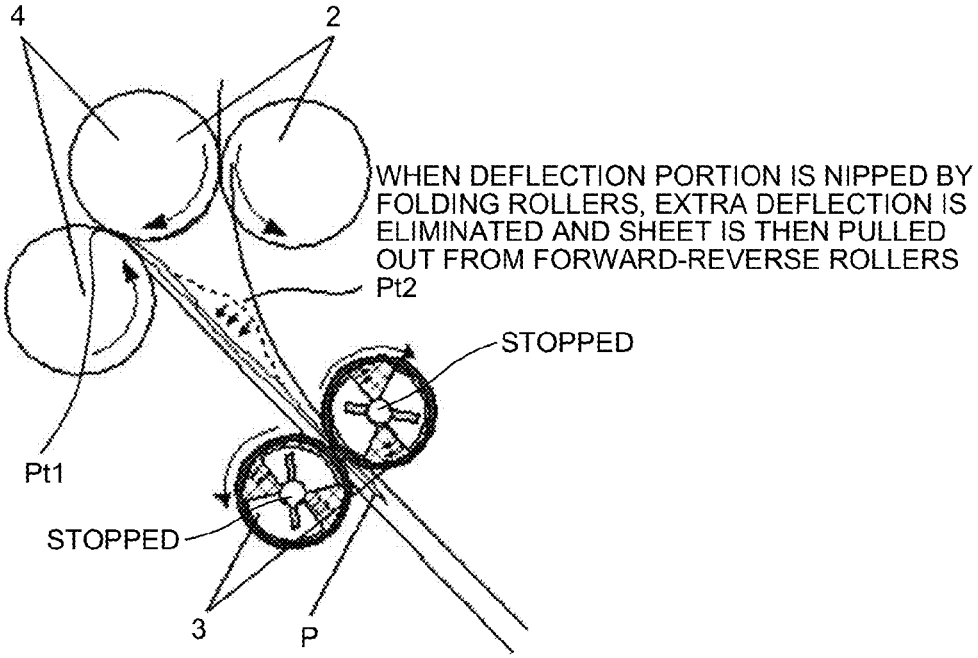
FIG. 18 is a diagram for explaining behavior illustrating that a deflection portion of the sheet is nipped by the second folding roller pair, an extra deflection on the downstream side is eliminated, and the sheet is conveyed while being folded in a deflection-free condition.

In FIGS. 16 to 18, the leading end P1 of the sheet P and the sheet portion (a single sheet portion) P1a on the first fold side are introduced to the nip of the second folding roller pair 4 along a guide plate 4*a* that extends up to the nip, and are nipped and pulled by the nip. Consequently, no paper jam or deflection is to arise between the leading end P1 of the sheet P and the second folding roller pair 4.

FIGS. 19 to 24 are explanatory diagrams illustrating an example of the behavior of the forward-reverse roller pair 3 in the first embodiment. The operating principle is as described with reference to FIGS. 15 to 18.

Figure 20:
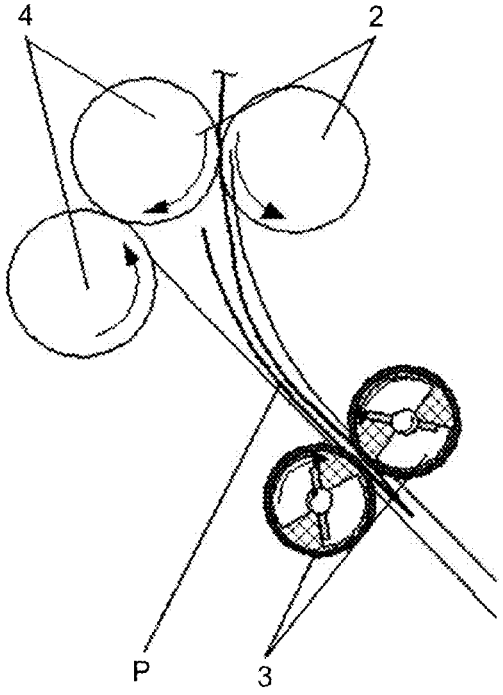
FIG. 20 is a diagram for explaining behavior illustrating a condition in which the forward-reverse roller pair holds the sheet and further conveys the sheet down to a preset position from the condition depicted in FIG. 19.
Figure 21:
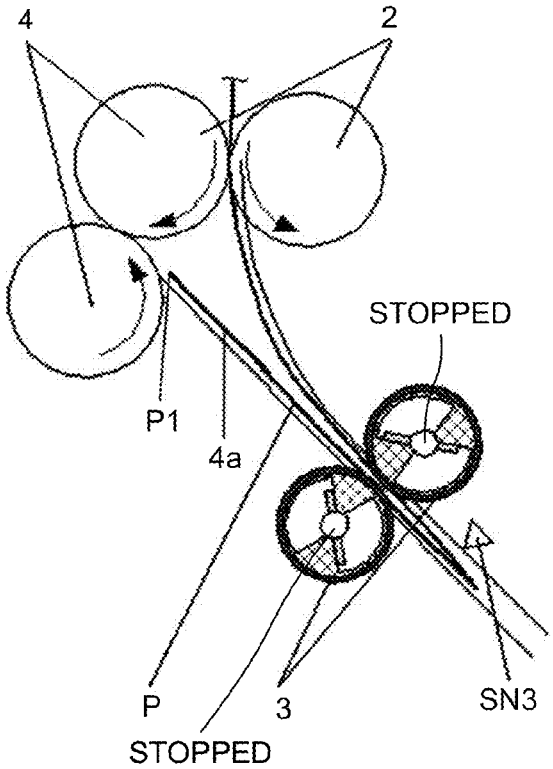
FIG. 21 is a diagram for explaining behavior illustrating a condition when a sheet stopping position is determined based on the detection output of a third sheet detecting sensor from the condition depicted in FIG. 20.
Figure 22:
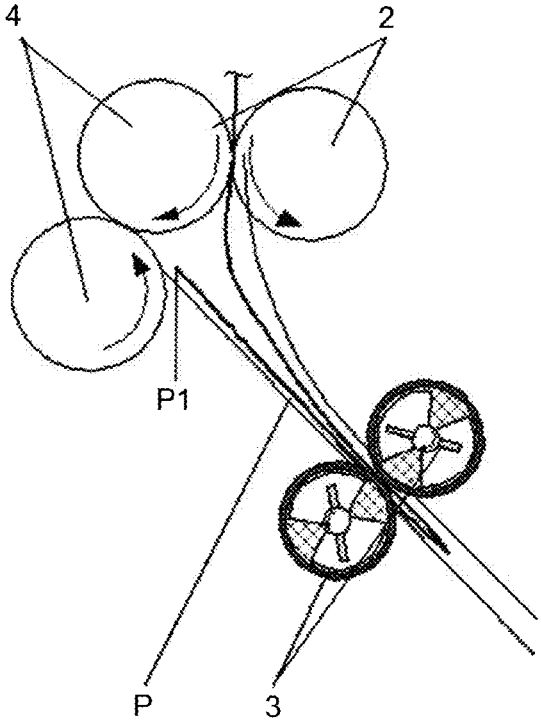
FIG. 22 is a diagram for explaining behavior illustrating a condition in which the drive members move within the respective idling areas idling the drive members after the forward-reverse roller pair is stopped at the position illustrated in FIG. 21.

First, before the sheet P conveyed by the first folding roller pair 2 goes into the nip of the forward-reverse roller pair 3, the forward-reverse roller pair 3 is rotating in the directions of arrows indicated in FIG. 19 (FIG. 19). As the sheet P is further conveyed, and after the forward-reverse roller pair 3 holds the sheet P, the forward-reverse roller pair 3 conveys the sheet P up to a preset position (FIG. 20). In such case, the third sheet detecting sensor SN3 is provided at a position peripheral to the forward-reverse roller pair 3 as in the foregoing, and thus the sheet stop position is determined based on the detection output of the third sheet detecting sensor SN3 (FIG. 21). In place of such third sheet detecting sensor SN3, the sheet stop position can also be determined by the pulse count control of the third drive motor M3, the encoder pulse output of a DC motor, and others.

Figure 23:
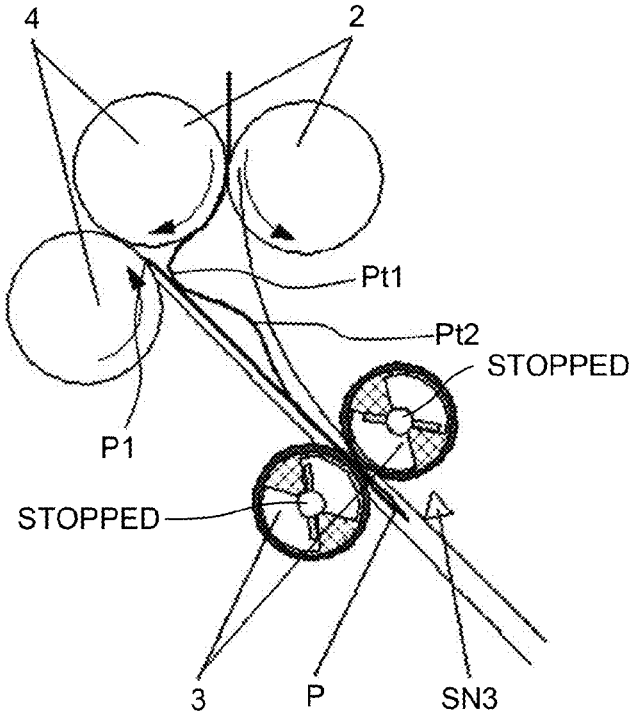
FIG. 23 is a diagram for explaining behavior illustrating a condition in which the drive portion bodies are stopped from the condition depicted in FIG. 22.

After the forward-reverse roller pair 3 is stopped at the position illustrated in FIG. 21, the drive members 3*a*4 (the drive portion bodies 3*a*1) are idled such that the drive members 3*a*4 are to move within the idling areas 3*a* until the play runs out (FIG. 22), and then the drive portion bodies 3*a*1 are stopped again (FIG. 23). The idling is in the direction opposite to the rotational direction thereof before the forward-reverse roller pair 3 is stopped. In this case, as the same as when the conveyance in the downstream direction is stopped as illustrated in FIG. 21, the sheet stop position is determined using the third sheet detecting sensor SN3 (can be provided separately), or by the pulse count control of the third drive motor M3, the encoder output of a DC motor, and others.

Figure 24:
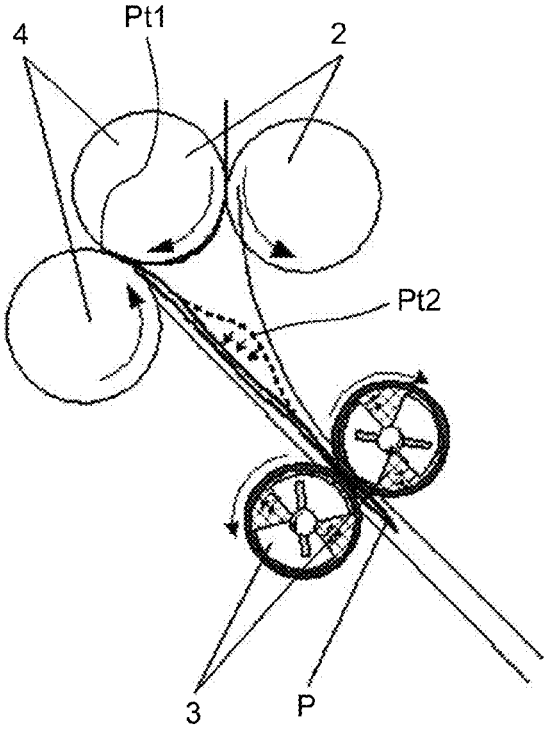
FIG. 24 is a diagram for explaining behavior illustrating a condition when the forward-reverse roller pair is driven after the sheet is pulled by the second folding roller pair and a preset time that is before the play of the drive members runs out elapses.

In this condition, because the forward-reverse roller pair 3 is locked for the rotation to move the sheet P in the downstream direction, the forward-reverse roller pair 3 is not moved due to the stiffness of the sheet P, and thus the sheet P is not delivered downstream from the stopped position. Subsequently, after the sheet P is pulled by the second folding roller pair 4, and a preset time that is before the play of the drive members 3*a*4 runs out elapses, the forward-reverse roller pair 3 (the second conveying roller pair R6) is driven to rotate (FIG. 24). At this time, the rotational speed of the forward-reverse roller pair 3 is set equal to or higher than the rotational speed of the second folding roller pair 4. Consequently, pulling the sheet P from both sides is never to arise between the second folding roller pair 4 and the forward-reverse roller pair 3.

In consideration of the efficiency of sheet processing, the idling area 3*a* is preferably smaller as the operating time of the play is shorter.

Second Embodiment

Figure 25:
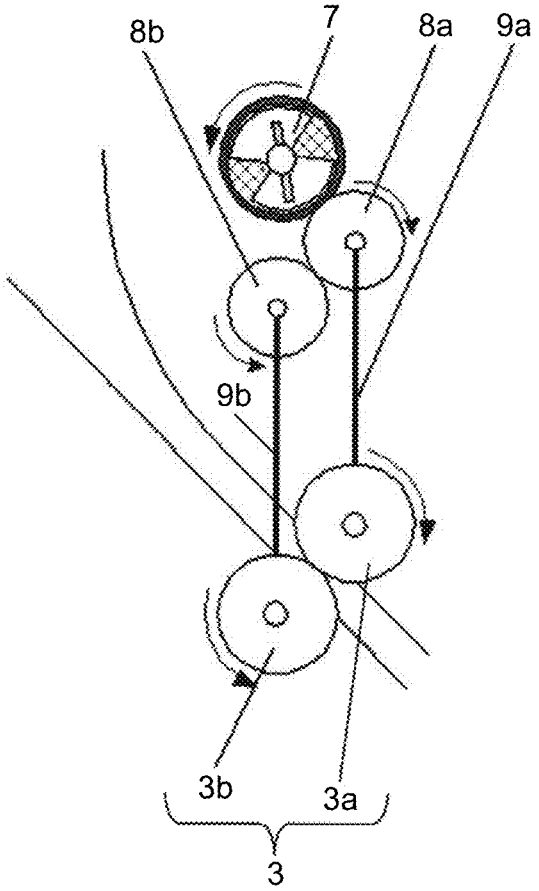
FIG. 25 is a diagram schematically illustrating the configuration of a forward-reverse roller pair according to a second embodiment of the present invention.

FIG. 25 is a diagram schematically illustrating the configuration of the forward-reverse roller pair 3 according to a second embodiment.

The forward-reverse roller pair 3 in the second embodiment includes first and second drive rollers 3*a* and 3*b* that constitute a pair, first and second driven gears 8*a* and 8*b* that drive the first and the second drive rollers 3*a* and 3*b*, respectively, first and second transmission mechanisms 9*a* and 9*b* that transmit the driving force of the first and the second driven gears 8*a* and 8*b* to the first and the second drive rollers 3*a* and 3*b*, respectively, a drive gear 7 that drives the first driven gear 8*a*, and a not-depicted drive motor that drives the drive gear 7. The second driven roller 8*b* meshes with the first driven gear 8*a* and rotates in synchronization with the rotation of the drive gear 7, and the rotary driving force of the drive gear 7 is transmitted to the first and the second drive rollers 3*a* and 3*b*. In the second embodiment, the play mechanism illustrated in FIGS. 14A to 14D is provided to the drive gear 7.

The various other portions are configured as the same as those in the first embodiment, and function in the same manner.

As in the first embodiment, when the drive portion body 3*a*1 is provided with the play (an idling area) 3*a* and one of the forward-reverse roller pair 3 is configured as a driven roller, there is a concern that the roller may be rotated yielding to the stiffness of the sheet P. Consequently, it is necessary to make the roller not to be rotated (lock) even when it is pushed by the stiffness of the sheet P, and thus the two rollers are both configured as drive rollers in the second embodiment. The play of the drive portion body 3*a*1 may be provided to the drive gear 7 or on a gear upstream thereof.

Third Embodiment

Figure 26:
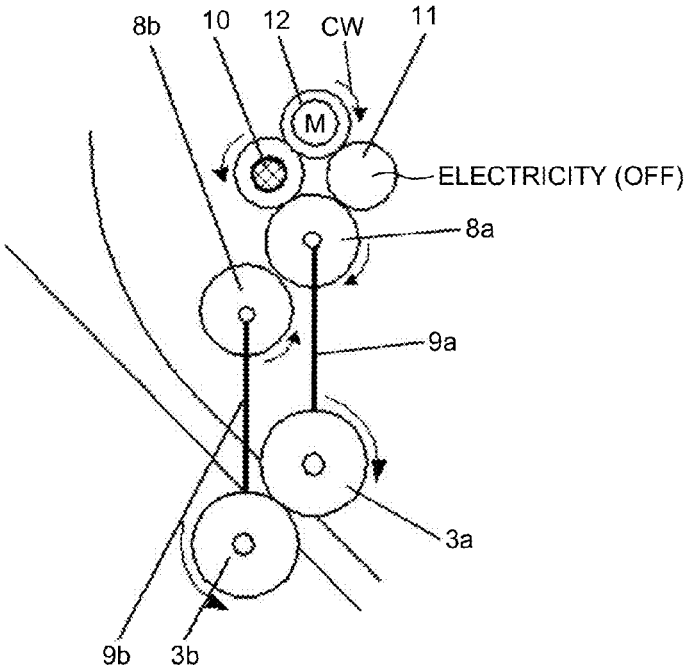
FIG. 26 is a diagram illustrating the behavior of a forward-reverse roller pair when a motor rotates in normal direction and a schematic configuration of a drive mechanism according to a third embodiment of the present invention.
Figure 27:
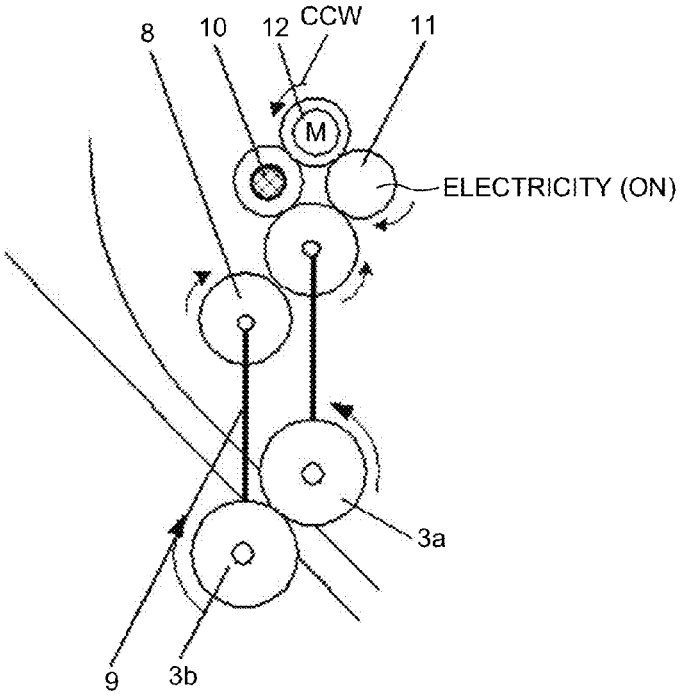
FIG. 27 is a diagram illustrating the behavior of the forward-reverse roller pair when the motor rotates in reverse direction and the schematic configuration of the drive mechanism in the third embodiment.
Figure 28:
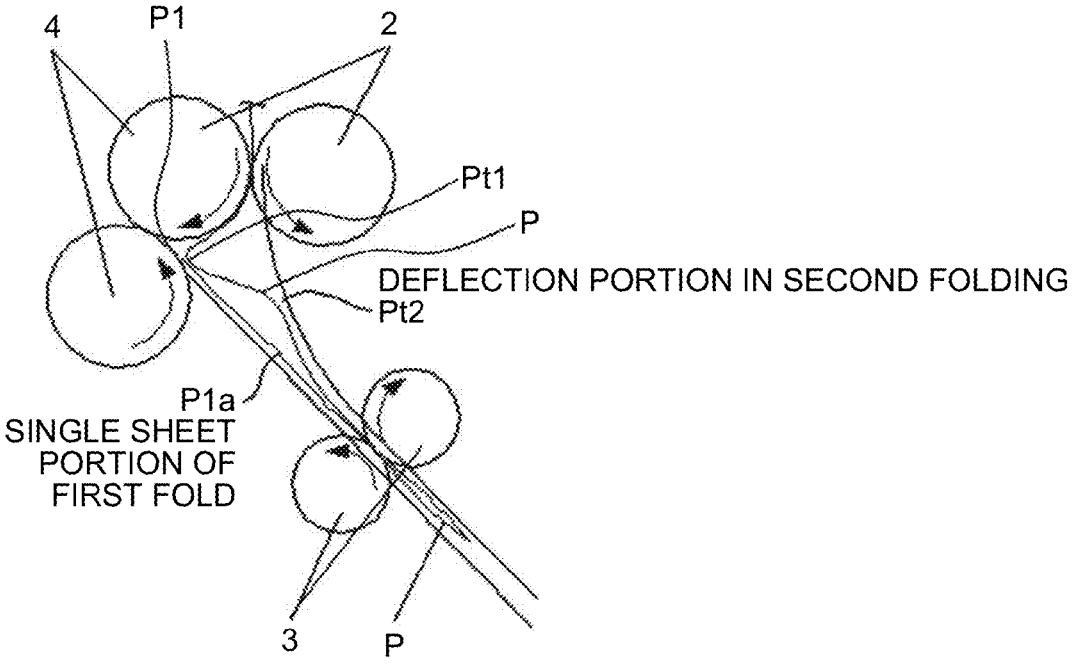
FIG. 28 is a diagram for explaining behavior illustrating a condition when a first folding roller pair and a forward-reverse roller pair are made to convey a sheet in directions conflicting with each other to form a deflection in the sheet and the second folding is to be performed by a second folding roller pair in a conventional nip-reverse method.
Figure 29:
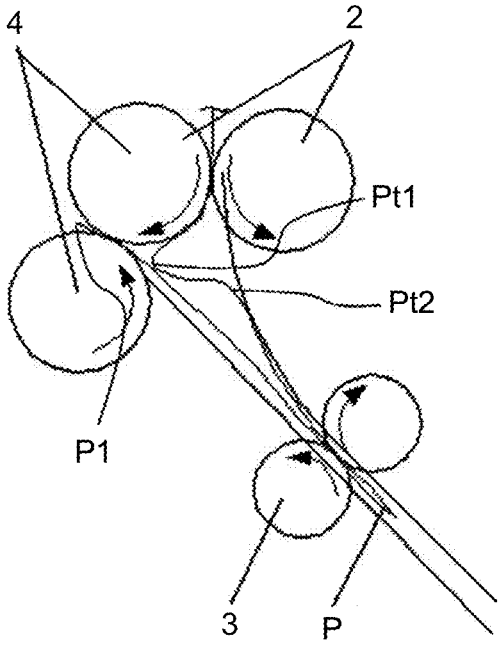
FIG. 29 is a diagram for explaining behavior illustrating a condition in which a sheet portion on the first fold side is drawn into the nip of the second folding roller pair before the deflection in the second fold portion disappears from the condition depicted in FIG. 28.
Figure 30:
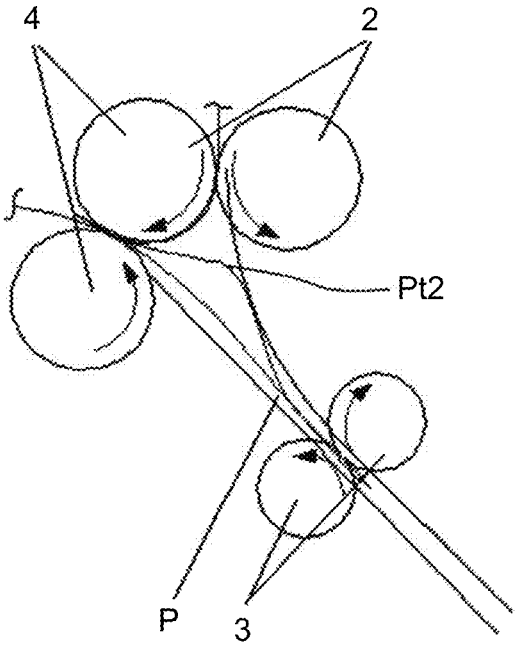
FIG. 30 is a diagram for explaining behavior illustrating a condition when the second folding process is performed from the condition depicted in FIG. 29.
Figure 31:
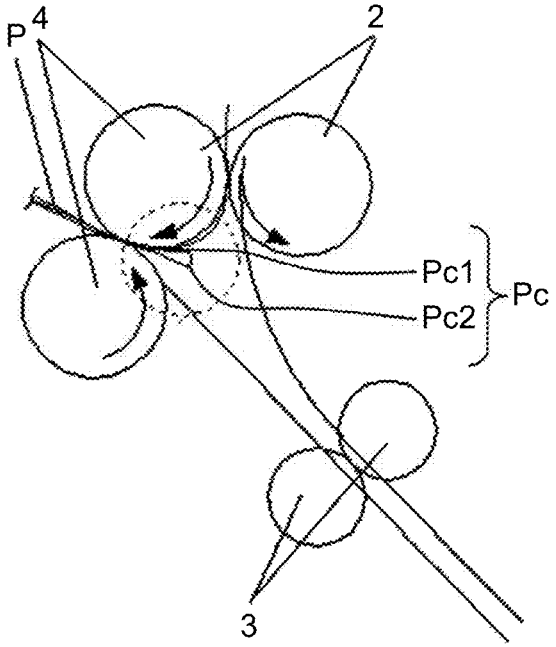
FIG. 31 is a diagram for explaining behavior illustrating a condition when the second folding process is performed under the condition depicted in FIG. 30 and a duplicate fold is to arise.
Figure 32:
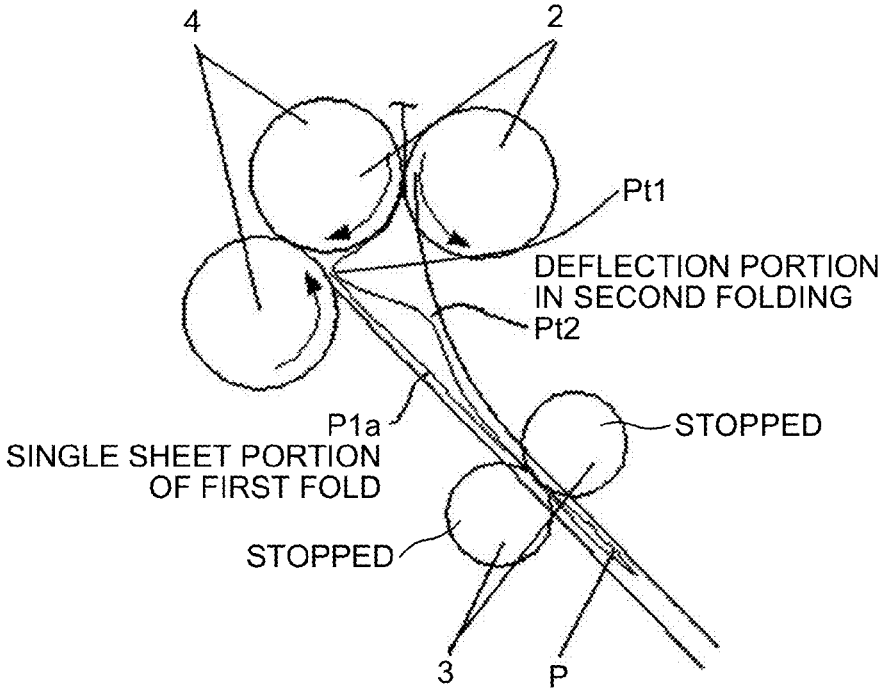
FIG. 32 is a diagram for explaining behavior illustrating a condition when the leading end of the sheet formed in the first folding process is stopped short of the nip of the second folding roller pair to prevent the duplicate fold from arising.
Figure 33:
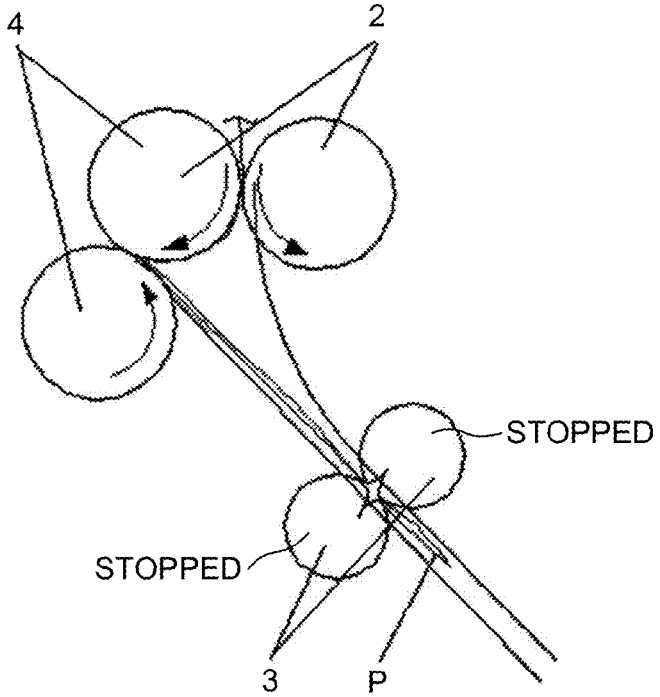
FIG. 33 is a diagram for explaining behavior illustrating a condition when the sheet is pulled from both sides between the second folding roller pair and the forward-reverse roller pair from the condition depicted in FIG. 32.

FIGS. 26 and 27 are diagrams schematically illustrating the configuration of the forward-reverse roller pair 3 according to a third embodiment.

In the third embodiment, a one-way clutch 10 and an electromagnetic clutch 11 are used in the drive configuration of the forward-reverse roller pair 3 so that the same effect as those by the configuration of the drive portion body 3*a*1 provided with the play 3*a* in the first embodiment and in the second embodiment can be yielded.

More specifically, in the third embodiment, the one-way clutch 10 and the electromagnetic clutch 11 are coupled with the first driven gear 8*a* in the second embodiment, and the drive mechanism of a motor 12 is coupled with the one-way clutch 10 and the electromagnetic clutch 11. The configurations of others are the same as those in the second embodiment.

In such a configuration, when the motor 12 rotates in normal direction (in the clockwise direction in FIG. 26: the arrow CW direction), the forward-reverse roller pair 3 rotates in the direction to convey the sheet P upstream. At that time, the electromagnetic clutch 11 is in an off-state. In a stopped condition, because of the one-way clutch 10 being provided, when the sheet P is pulled in the upstream direction, the forward-reverse roller pair 3 follows to rotate, and when the sheet P is conveyed in the downstream direction, the forward-reverse roller pair 3 is in a locked state.

Meanwhile, when the motor 12 rotates in reverse direction (in the counter-clockwise direction in FIG. 27: the arrow CCW direction), the electromagnetic clutch 11 is set in an on-state. Consequently, the forward-reverse roller pair 3 rotates in the opposite direction (in the direction to convey the sheet P downstream), but the gear on the one-way clutch 10 side is in a non-rotatable state. Thus, the above-described functions of (a) to (c) that are the basic functions of the forward-reverse roller pair 3 can be acquired reliably, whereby a duplicate fold phenomenon can be avoided.

The various other portions are configured as the same as those in the first embodiment and the second embodiment, and function in the same manner.

In accordance with the third embodiment, the behavior equivalent to the mechanism in which the drive portion is provided with the idling area (play) 3*a* can be achieved by combining the existing one-way clutch 10 and the electromagnetic clutch 11.

As in the foregoing, the exemplary embodiments have the following effects:

1) The first folding roller pair 2 (the pair of the second conveying roller R3 and the third conveying roller R4: a first conveying member pair) that folds the sheet P, the forward-reverse roller pair 3 (the second conveying roller pair R6: a second conveying member pair) that conveys downstream the sheet P folded by the first folding roller pair 2, the second folding roller pair 4 (the pair of the second conveying roller R3 and the fourth conveying roller R5: a third conveying member pair) that further folds the sheet P folded by the first folding roller pair 2 (the first conveying member pair) are provided, and the forward-reverse roller pair 3 is rotatable forward and reversely when driven to convey, and is locked in one rotational direction but is rotatable in the other rotational direction while not driven, whereby the above-described basic functions (a) to (c) can be exercised. Consequently, when a folding process is performed by the nip-reverse method, a duplicate fold can be prevented from arising in the second sheet folding process.

2) The first conveying roller pair R1 (a fourth conveying member pair) that conveys the sheet P, and the pair of the first conveying roller R2 and the second conveying roller R3 (a fifth conveying member pair) that receives the sheet P conveyed by the first conveying roller pair R1 and conveys the sheet P to a downstream stage are further provided, and the pair of the first conveying roller R2 and the second conveying roller R3 is rotated in the opposite direction in a state in which the sheet P is held by the first conveying roller pair R1 and the pair of the first conveying roller R2 and the second conveying roller R3, whereby a portion of the sheet P that corresponds to a crease can be reliably introduced to the nip of the first folding roller pair 2.

3) The rotatable range is preset, whereby a subsequent conveying operation in the opposite direction after idling can be performed reliably.

4) The rotatable range preset is a rotational range sufficient to eliminate the deflection Pt2 of the sheet P that arises between the forward-reverse roller pair 3 (the second conveying member pair) and the second folding roller pair 4 (the third conveying member pair) when the forward-reverse roller pair 3 (the second conveying member pair) is stopped and the second folding roller pair 4 (the third conveying member pair) conveys the sheet P downstream, whereby the idling sufficient to eliminate the deflection that arises in the second folding process can be ensured, and thus a duplicate fold phenomenon that arises in the second folding process can be avoided reliably.

5) The forward-reverse roller pair 3 (the second conveying member pair) is in a stopped state when the second folding roller pair 4 (the third conveying member pair) folds the sheet P, whereby the sheet P can reliably be drawn into the nip of the second folding roller pair 4.

6) The forward-reverse roller pair 3 (the second conveying member pair) is driven after the sheet P is conveyed by the second folding roller pair 4 (the third conveying member pair), the forward-reverse roller pair 3 is started to idle as being pulled by the sheet P along with the conveyance, and a preset time elapses before the idling ends, whereby the second folding roller pair 4 can pull out the sheet P from the forward-reverse roller pair 3 without any load while folding the sheet P in a deflection-free condition.

7) The conveying speed of the sheet P when the forward-reverse roller pair 3 (the second conveying member pair) is driven to rotate is set to a speed equivalent to or higher than the conveying speed of the sheet P by the second folding roller pair 4 (the third conveying member pair), whereby pulling the sheet P from both sides between the forward-reverse roller pair 3 and the second folding roller pair 4 is never to arise. Consequently, damage to the sheet P attributable to the pull from both sides is never caused.

8) The forward-reverse roller pair 3 (the second conveying member pair) includes the drive member 3*a*4 that rotates concentrically with the driving shaft 3*a*2, and the drive portion body 3*a*1 (a drive portion) including the driven portion 3*a*3 driven by the drive member 3*a*4, and the idling area 3*a* in which the drive member 3*a*4 idles, whereby the functions (b) and (c) can be exercised reliably.

9) Each roller of the forward-reverse roller pair 3 is configured as a drive roller, whereby there is no danger of being rotated yielding to the stiffness of the sheet P, and thus the function (b) can be exercised reliably.

10) Each roller of the forward-reverse roller pair 3 (the second conveying member pair) is a drive roller, and the drive portion of one of the drive rollers of the forward-reverse roller pair 3 is provided with the one-way clutch 10 and the drive portion of the other of the drive rollers is provided with the electromagnetic clutch 11, whereby the functions (a) to (c) that are the basic functions of the forward-reverse roller pair 3 can be acquired reliably.

11) The image forming system 1 includes the folding process apparatus 100 (the sheet processing apparatus) that has any of the configurations described in items 1) to 10) above and the image forming apparatus 200, whereby the system that has the effects described in items 1) to 10) can be provided.

In the description of the effects of the exemplary embodiments above, the various portions in the embodiments are indicated with the respective constituent elements in claims in parenthesis or given with reference signs to clarify the correspondence relation of the both.

According to the embodiment, a duplicate fold can be prevented from arising in the second sheet folding process when the folding process is performed by the nip-reverse method.

All examples and conditional language recited herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A sheet processing apparatus comprising:

a first conveying member pair that folds a sheet;

a second conveying member pair that conveys downstream the sheet folded by the first conveying member pair; and a third conveying member pair that further folds the sheet folded by the first conveying member pair, wherein the second conveying member pair is rotatable forward and reversely when driven to convey, and is locked in one rotational direction but is rotatable in the other rotational direction when not driven, and the second conveying member pair includes a drive member that rotates concentrically with a driving shaft, and a drive portion including a driven member driven by the drive member, and an idling area in which the drive member idles.

2. The sheet processing apparatus according to claim 1, further comprising:

a fourth conveying member pair that conveys the sheet; and a fifth conveying member pair that receives the sheet conveyed by the fourth conveying member pair and conveys the sheet to a downstream stage, wherein the fifth conveying member pair is rotated in an opposite direction in a state in which the sheet is held by the fourth conveying member pair and the fifth conveying member pair.

3. The sheet processing apparatus according to claim 1, wherein a rotatable range is preset.

4. The sheet processing apparatus according to claim 3, wherein the preset rotatable range is a rotational range sufficient to eliminate a deflection of the sheet that arises between the second conveying member pair and the third conveying member pair when the second conveying member pair is stopped and the third conveying member pair conveys the sheet downstream.

5. The sheet processing apparatus according to claim 4, wherein the second conveying member pair is in a stopped state when the third conveying member pair folds the sheet.

6. The sheet processing apparatus according to claim 5, wherein the second conveying member pair is driven to rotate in a direction in which the second conveying member pair is pulled, after the sheet is conveyed by the third conveying member pair, causing the sheet to pull the second conveying member pair to cause the second conveying member pair to start to idle, and a preset time elapses before idling ends.

7. The sheet processing apparatus according to claim 6, wherein a conveying speed of the sheet when the second conveying member pair is driven to rotate is set to a speed equivalent to or higher than a conveying speed of the sheet by the third conveying member pair.

8. The sheet processing apparatus according to claim 1, wherein each member of the second conveying member pair is a drive roller.

9. The sheet processing apparatus according to claim 1, wherein each member of the second conveying member pair is a drive roller, a drive portion of one of the drive rollers of the second conveying member pair is provided with a one-way clutch, and a drive portion of the other of the drive rollers is provided with an electromagnetic clutch.

10. An image forming system comprising a sheet processing apparatus, wherein the sheet processing apparatus comprising:

a first conveying member pair that folds a sheet;

a second conveying member pair that conveys downstream the sheet folded by the first conveying member pair; and a third conveying member pair that further folds the sheet folded by the first conveying member pair, wherein the second conveying member pair is rotatable forward and reversely when driven to convey, and is locked in one rotational direction but is rotatable in the other rotational direction when not driven, and the second conveying member pair includes a drive member that rotates concentrically with a driving shaft, and a drive portion including a driven member driven by the drive member, and an idling area in which the drive member idles.

11. A sheet processing apparatus comprising:

a first conveying member pair that folds a sheet;

a second conveying member pair that conveys downstream the sheet folded by the first conveying member pair; and a third conveying member pair that further folds the sheet folded by the first conveying member pair, wherein the second conveying member pair is rotatable forward and reversely when driven to convey, and is locked in one rotational direction but is rotatable in the other rotational direction when not driven, each member of the second conveying member pair is a drive roller, a drive portion of one of the drive rollers of the second conveying member pair is provided with a one-way clutch, and a drive portion of the other of the drive rollers is provided with an electromagnetic clutch.

12. An image forming system comprising a sheet processing apparatus, wherein the sheet processing apparatus comprising:

a first conveying member pair that folds a sheet;

a second conveying member pair that conveys downstream the sheet folded by the first conveying member pair; and a third conveying member pair that further folds the sheet folded by the first conveying member pair, wherein the second conveying member pair is rotatable forward and reversely when driven to convey, and is locked in one rotational direction but is rotatable in the other rotational direction when not driven, each member of the second conveying member pair is a drive roller, a drive portion of one of the drive rollers of the second conveying member pair is provided with a one-way clutch, and a drive portion of the other of the drive rollers is provided with an electromagnetic clutch.

* * * * *